US011285727B2

(12) United States Patent
Nukui et al.

(10) Patent No.: US 11,285,727 B2
(45) Date of Patent: Mar. 29, 2022

(54) LIQUID CARTRIDGE INCLUDING CIRCUIT BOARD AND DEFORMABLE MEMBER

(71) Applicant: BROTHER KOGYO KABUSHIKI KAISHA, Nagoya (JP)

(72) Inventors: Kosuke Nukui, Nagoya (JP); Akihito Ono, Nagoya (JP); Fumio Nakazawa, Okazaki (JP); Tetsuro Kobayashi, Chiryu (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/148,673

(22) Filed: Jan. 14, 2021

(65) Prior Publication Data

US 2021/0229452 A1 Jul. 29, 2021

Related U.S. Application Data

(63) Continuation of application No. 16/531,330, filed on Aug. 5, 2019, now Pat. No. 10,894,421.

(30) Foreign Application Priority Data

Aug. 31, 2018 (JP) ..... JP2018-162365

(51) Int. Cl.
*B41J 2/175* (2006.01)

(52) U.S. Cl.
CPC ..... *B41J 2/17543* (2013.01); *B41J 2/17509* (2013.01); *B41J 2/17513* (2013.01);
(Continued)

(58) Field of Classification Search
CPC ..... B41J 2/17543; B41J 2/17513; B41J 2/17553; B41J 2/17509; B41J 2/17523;
(Continued)

(56) References Cited

U.S. PATENT DOCUMENTS 7,527,344 B2 5/2009 Kitagawa
2005/0151810 A1 7/2005 Graham et al.
(Continued)

FOREIGN PATENT DOCUMENTS

CN 1636745 A 7/2005
CN 203004524 U 6/2013
(Continued)

OTHER PUBLICATIONS

Extended European Search Report issued in related European Patent Application No. 19184809.2, dated Dec. 19, 2019.
(Continued)

*Primary Examiner* — Anh T Vo
(74) *Attorney, Agent, or Firm* — Merchant & Gould P.C.

(57) ABSTRACT

A liquid cartridge includes: a housing having a storage chamber; a liquid passage in communication with the storage chamber; a circuit board; a deformable member; and a movable surface. The liquid passage extends in a first lateral direction from the housing when the housing is in an operational posture. The circuit board is positioned higher than the storage chamber in a vertical direction perpendicular to the first lateral direction and vertically movable relative to the housing. The deformable member is positioned higher than the storage chamber and is lower than the circuit board. The deformable member is deformable vertically relative to the housing. The circuit board is movable vertically in accordance with deformation of the deformable member. The movable surface is positioned further in a second lateral direction opposite the first lateral direction than the circuit board. The movable surface faces upward and is vertically movable relative to the housing.

15 Claims, 15 Drawing Sheets

(52) U.S. Cl.
CPC ..... *B41J 2/17523* (2013.01); *B41J 2/17553* (2013.01); *B41J 2002/17516* (2013.01)

(58) Field of Classification Search
CPC ..... B41J 2002/17516; B41J 2/17546; B41J 2/1752; B41J 2/17526; B41J 2/1753; B41J 2/17503; B41J 2/175
See application file for complete search history.

(56) References Cited

U.S. PATENT DOCUMENTS

| | | | |
|---|---|---|---|
| 2005/0151811 | A1 | 7/2005 | Shimizu et al. |
| 2007/0052774 | A1 | 3/2007 | Shimizu et al. |
| 2009/0244224 | A1 | 10/2009 | Koizumi et al. |
| 2010/0045755 | A1 | 2/2010 | Kobayashi |
| 2011/0310197 | A1 | 12/2011 | Yazawa |
| 2014/0009543 | A1 | 1/2014 | Yazawa |
| 2014/0300671 | A1 | 10/2014 | Nie |
| 2017/0085031 | A1 | 3/2017 | Ishizawa et al. |
| 2017/0282580 | A1 | 10/2017 | Takahashi et al. |
| 2018/0093482 | A1 | 4/2018 | Takahashi et al. |
| 2018/0093484 | A1 | 4/2018 | Nukui et al. |
| 2018/0093486 | A1 | 4/2018 | Nukui et al. |
| 2020/0070530 | A1* | 3/2020 | Nukui ..... B41J 2/17513 |

FOREIGN PATENT DOCUMENTS

| | | | |
|---|---|---|---|
| CN | 203185847 | U | 9/2013 |
| CN | 203401813 | U | 1/2014 |
| CN | 107264042 | A | 10/2017 |
| CN | 206983529 | U | 2/2018 |
| CN | 107878034 | A | 4/2018 |
| CN | 107878036 | A | 4/2018 |
| CN | 107960066 | A | 4/2018 |
| CN | 207683142 | U | 8/2018 |
| EP | 2 607 088 | A2 | 6/2013 |
| EP | 3 064 359 | A1 | 9/2016 |
| EP | 3 225 401 | A1 | 10/2017 |
| EP | 3 300 903 | A1 | 4/2018 |
| JP | 63-4953 | A | 1/1988 |
| JP | 2005-205893 | A | 8/2005 |
| JP | 2008-155596 | A | 7/2008 |
| JP | 2012-858 | A | 1/2012 |
| JP | 2017-52220 | A | 3/2017 |
| JP | 2017-56706 | A | 3/2017 |
| JP | 2018-52011 | A | 4/2018 |
| WO | 2017/006364 | A1 | 1/2017 |
| WO | 2017/130242 | A1 | 8/2017 |
| WO | 2017/130243 | A1 | 8/2017 |

OTHER PUBLICATIONS

International Search Report issued in related International Patent Application No. PCT/JP2018/042445, dated Jan. 22, 2019.
Written Opinion issued in related International Patent Application No. PCT/JP2018/042445, dated Jan. 22, 2019.
Notification of the First Office Action issued in corresponding Chinese Patent Application No. 201910812691.8, dated Jan. 26, 2022.

* cited by examiner

LIQUID CARTRIDGE INCLUDING CIRCUIT BOARD AND DEFORMABLE MEMBER

CROSS REFERENCE TO RELATED APPLICATION

This application is a continuation of U.S. patent application Ser. No. 16/531,330, filed Aug. 5, 2019, which further claims priority from Japanese Patent Application No. 2018-162365 filed Aug. 31, 2018. The entire content of the priority application is incorporated herein by reference.

TECHNICAL FIELD

The present disclosure relates to a liquid cartridge storing liquid therein.

BACKGROUND

There has been conventionally known a system including an ink cartridge, and an inkjet recording device. The inkjet recording device includes an attachment portion in which the ink cartridge can be mounted and from which the ink cartridge can be extracted. The inkjet recording apparatus has a mechanism for retaining the ink cartridge in a mounted state in which the ink cartridge is mounted in the attachment portion.

Japanese Patent Application Publication No. 2017-56706 discloses a printer having an attachment portion in which a lever is provided. When an ink cartridge is mounted in the attachment portion and the lever is pushed downward, the lever is engaged with the ink cartridge to prevent the ink cartridge from being extracted from the attachment portion. By operating the lever, the ink cartridge can be extracted from the attachment portion of this printer.

SUMMARY

Here, a space for providing the lever is necessary in the attachment portion of the printer disclosed in Japanese Patent Application Publication No. 2017-56706. This causes a volume of the ink that can be stored in the ink cartridge to be reduced.

Instead of the configuration in which the attachment portion includes the lever, a configuration in which the ink cartridge includes a lever is conceivable. Even in the latter case, however, there is still a problem that the configuration requires a space for providing the lever in the ink cartridge. Hence, the volume of the ink that can be stored in the ink cartridge is also reduced.

In view of the foregoing, it is an object of the present disclosure to provide a liquid cartridge capable of being retained in an attachment portion while maintaining a volume of liquid that the liquid cartridge can store.

In order to attain the above and other objects, according to one aspect, the disclosure provides a liquid cartridge including: a housing; a liquid passage; a circuit board; a deformable member; and a movable surface. The housing is formed with a storage chamber configured for storing liquid therein. The liquid passage extends in a first lateral direction from the housing when the housing is in an operational posture. The liquid passage is in communication with the storage chamber. The circuit board is positioned higher than the storage chamber in a vertical direction perpendicular to the first lateral direction and is vertically movable relative to the housing. The deformable member is positioned higher than the storage chamber and is positioned lower than the circuit board in the vertical direction. The deformable member is deformable vertically relative to the housing. The circuit board is movable vertically in accordance with vertical deformation of the deformable member. The movable surface is positioned further in a second lateral direction opposite the first lateral direction than the circuit board. The movable surface faces upward and is vertically movable relative to the housing.

According to another aspect, the disclosure provides a liquid cartridge including: a housing; a liquid passage; a plate; a circuit board; a supporting member; a resilient member; a protruding part; and a leaf spring. The housing is formed with a storage chamber configured for storing liquid therein. The housing includes: a front wall; a rear wall; an upper wall; and a lower wall. The rear wall is positioned opposite to the front wall with respect to the storage chamber. The upper wall connects the front wall to the rear wall. The lower wall connects the front wall to the rear wall. The lower wall is positioned opposite to the upper wall with respect to the storage chamber. The liquid passage extends in a first lateral direction from the front wall when the housing is in an operational posture. The liquid passage is in communication with the storage chamber. The plate is positioned upward of the storage chamber in a vertical direction perpendicular to the first lateral direction. The circuit board is positioned upward of the storage chamber in the vertical direction and positioned further in a second lateral direction opposite the first lateral direction than the plate. The supporting member supports the circuit board. The resilient member connects the supporting member to the upper wall and is resiliently deformable vertically to move the circuit board and the supporting member vertically relative to the housing. The protruding part is provided at the upper wall and is positioned further in the second lateral direction than the circuit board. The protruding part protrudes upward from the upper wall to have a top surface facing upward. The leaf spring is provided at the lower wall and has a portion vertically overlapping the top surface.

According to still another aspect, the disclosure provides a a liquid cartridge including: a housing; a liquid passage; a circuit board; a supporting member; a resilient member; a leaf spring; and a protruding part. The housing is formed with a storage chamber configured for storing liquid therein. The housing includes: a front wall; a rear wall; an upper wall; and a lower wall. The rear wall is positioned opposite to the front wall with respect to the storage chamber. The upper wall connects the front wall to the rear wall. The lower wall connects the front wall to the rear wall. The lower wall is positioned opposite to the upper wall with respect to the storage chamber. The liquid passage extends in a first lateral direction from the front wall when the housing is in an operational posture. The liquid passage is in communication with the storage chamber. The circuit board is positioned upward of the storage chamber in a vertical direction perpendicular to the first lateral direction. The supporting member supports the circuit board. The resilient member connects the supporting member to the upper wall and is resiliently deformable vertically to move the circuit board and the supporting member vertically relative to the housing. The leaf spring is provided at the upper wall and is positioned further in a second lateral direction opposite the first lateral direction than the circuit board. The protruding part is provided at the lower wall and protrudes downward from the lower wall to have a bottom surface facing downward. The leaf spring has a portion vertically overlapping the bottom surface.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Hereinafter, an embodiment of the disclosure will be described in detail while referring to accompanying drawings. It would be apparent to those skilled in the art that the embodiment described below is merely an example of the present disclosure and modifications and variations may be made therein without departing from the scope of the disclosure.

<Overview of Printer 10>

Figure 1:
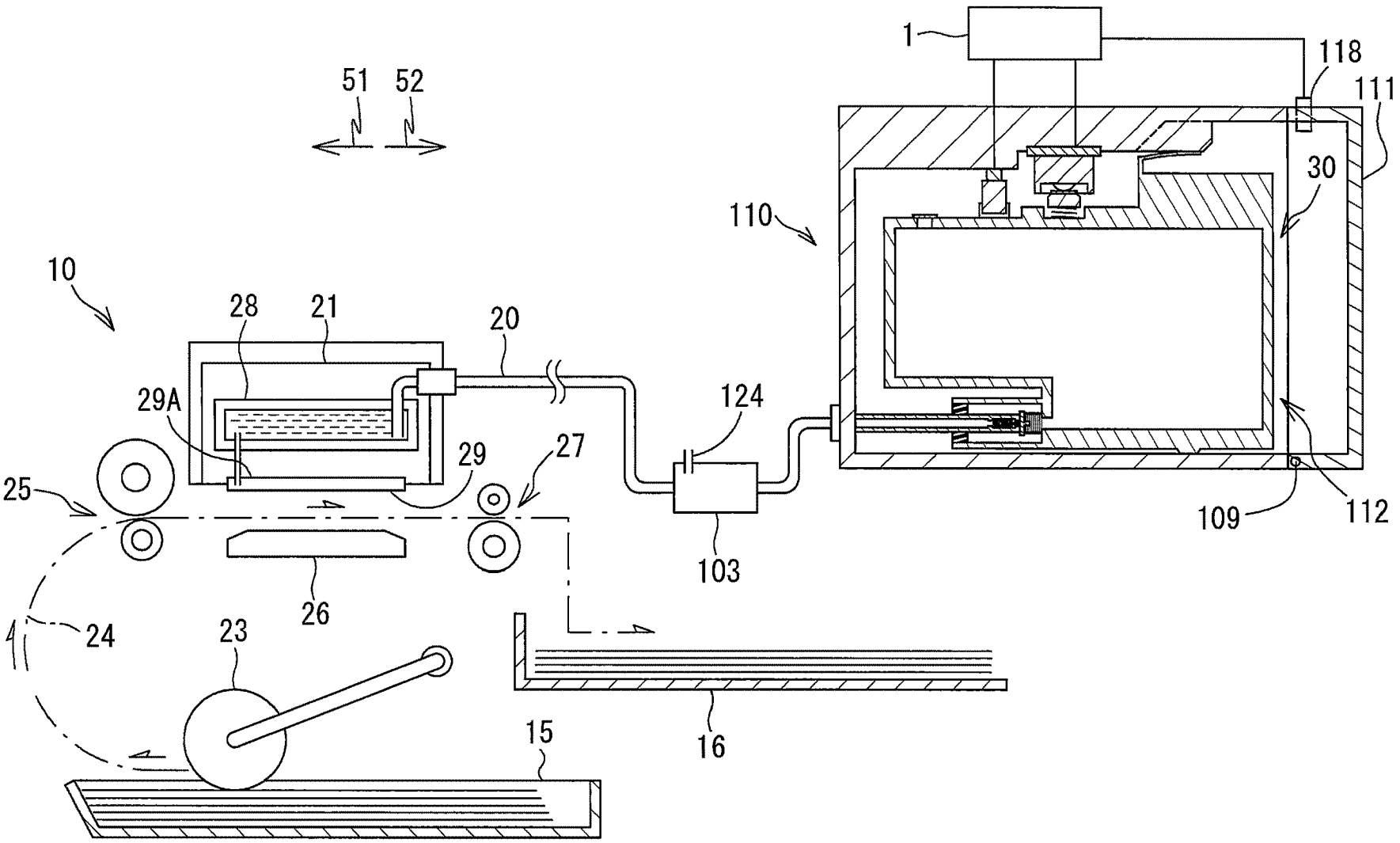
FIG. 1 is a vertical cross-sectional diagram schematically illustrating an internal configuration of a printer according to one embodiment of the present disclosure.

FIG. 1 illustrates a printer 10 according to one embodiment of the disclosure. The printer 10 is configured to record images on sheets of paper by ejecting ink droplets toward the sheets based on an inkjet recording method. The printer 10 includes a recording head 21, a cartridge-attachment portion 110, and ink tubes 20. Ink cartridges 30 storing ink to be supplied to the recording head 21 are detachably attachable to the cartridge-attachment portion 110. The ink tubes 20 connect the recording head 21 to the cartridge-attachment portion 110. An opening 112 is formed in one end of the cartridge-attachment portion 110.

Figure 9:
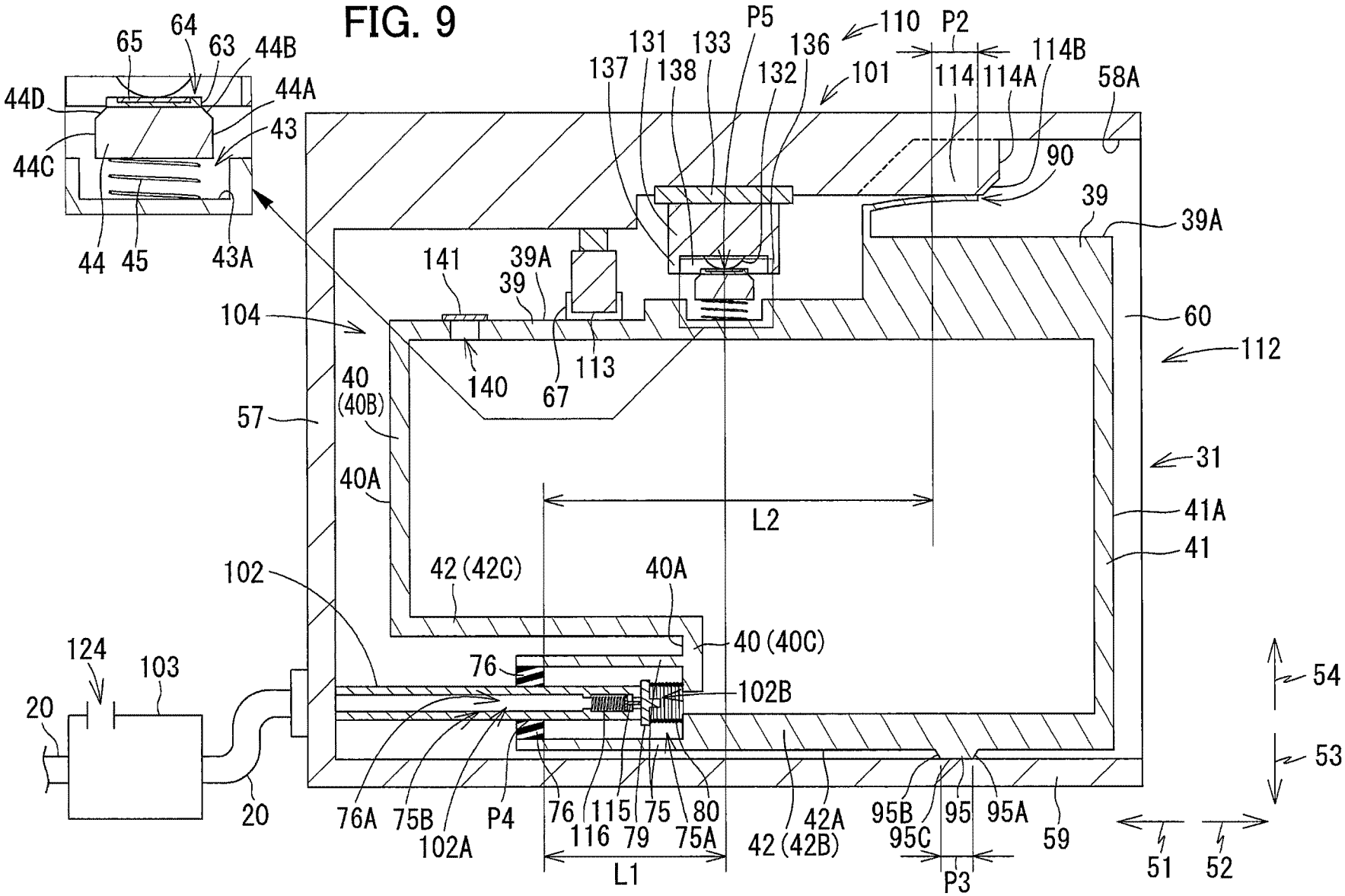
FIG. 9 is a vertical cross-sectional view illustrating a state where the ink cartridge according to the embodiment is completely inserted into the cartridge-attachment portion.

The ink cartridges 30 are inserted into the cartridge-attachment portion 110 through the opening 112 in order to be attached to the cartridge-attachment portion 110. The ink cartridges 30 are also extracted from the cartridge-attachment portion 110 through the opening 112. FIG. 1 illustrates one of the ink cartridges 30 in its attached state, i.e., a state where the ink cartridge 30 has been completely attached to the cartridge-attachment portion 110. FIG. 9 illustrates the ink cartridge 30 and the cartridge-attachment portion 110 of FIG. 1. That is, FIG. 9 illustrates the attached state of the ink cartridge 30.

In the following description, a direction in which the ink cartridge 30 is inserted into the cartridge-attachment portion 110 is defined as a frontward direction 51. Further, a posture of the ink cartridge 30 when being inserted frontward into and attached to the cartridge-attachment portion 110 is defined as an upright posture. Hence, when in its attached state, the ink cartridge 30 is in the upright posture. FIGS. 1, 4-10, and 13-15 illustrate the ink cartridge 30 in this upright posture. A rearward direction 52 is defined as a direction opposite the frontward direction 51, and is a direction in which the ink cartridge 30 is extracted from the cartridge-attachment portion 110. In the present embodiment, a horizontal direction is defined as a direction orthogonal to a direction of gravity and parallel to the insertion direction. Both the frontward direction 51 and the rearward direction 52 are parallel to the horizontal direction (direction orthogonal to the direction of gravity). The frontward direction 51 and the rearward direction 52 cross the direction of gravity.

Figure 4:
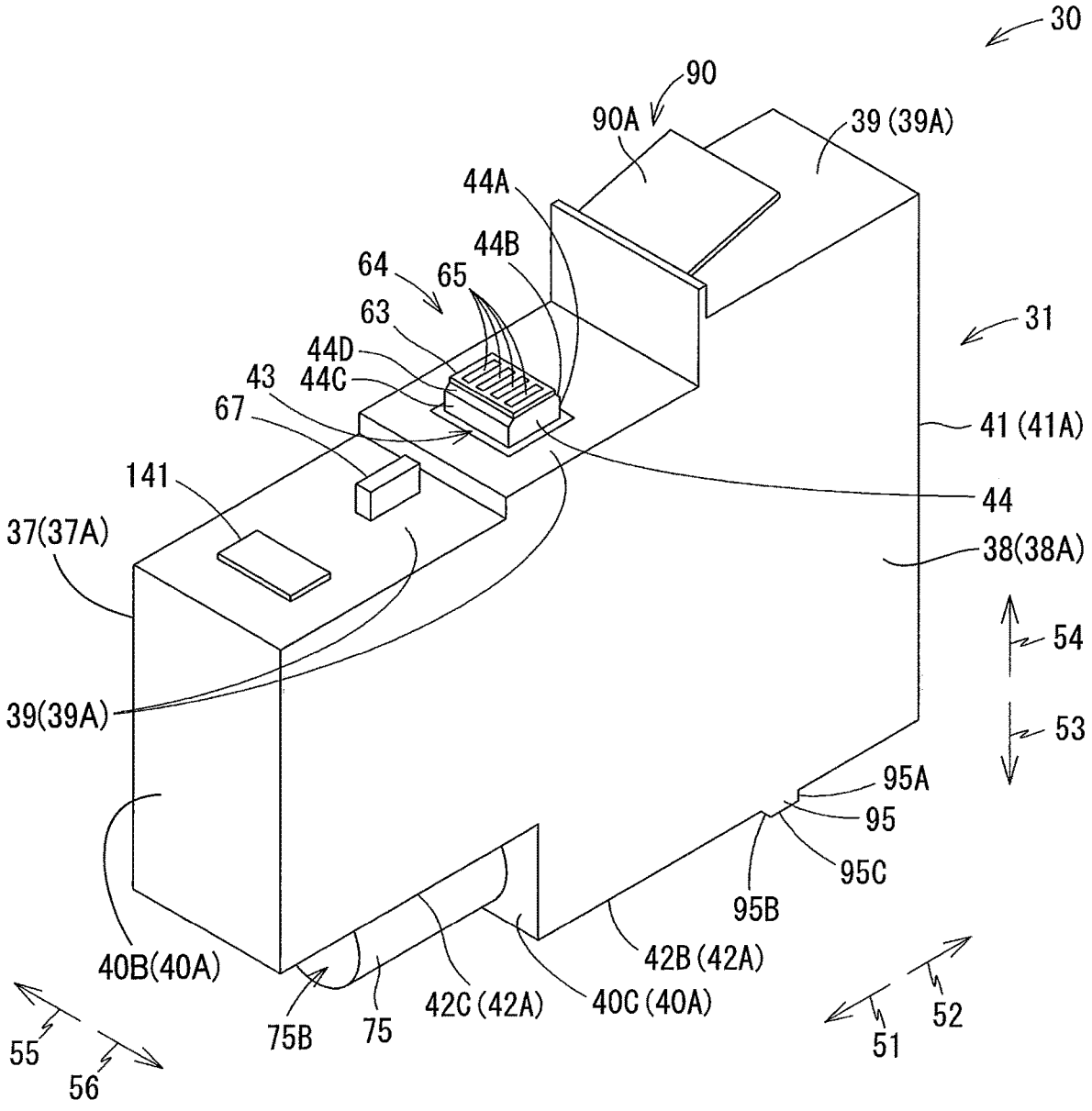
FIG. 4 is a perspective view of an ink cartridge according to the embodiment in an upright posture.
Figure 6A:
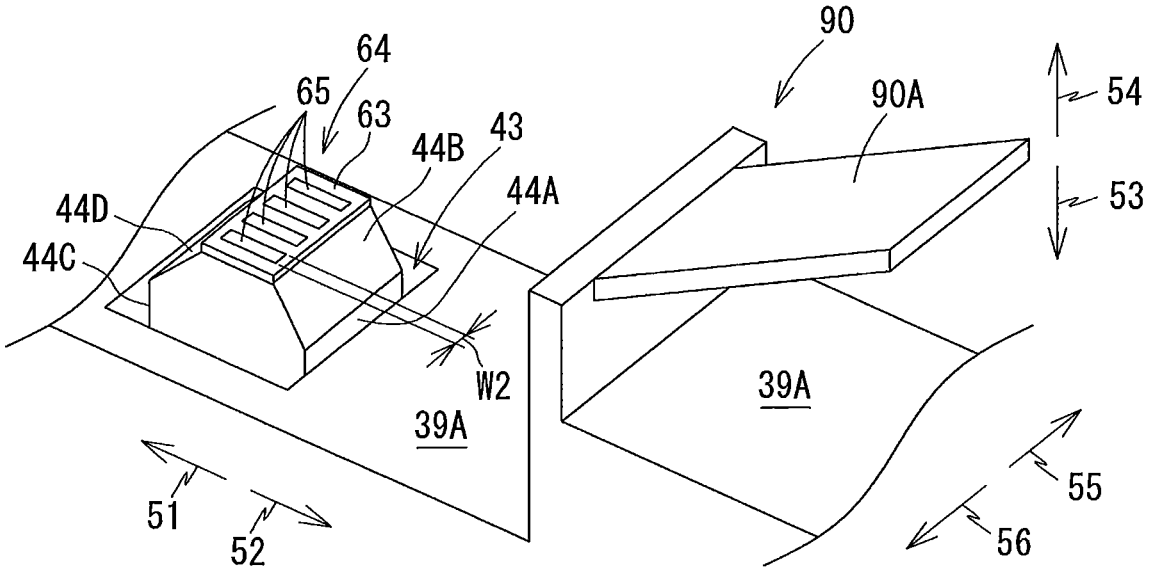
FIG. 6A is a perspective view illustrating configuration in the vicinity of a resilient member and a circuit board of the ink cartridge according to the embodiment in the upright posture.
Figure 6B:
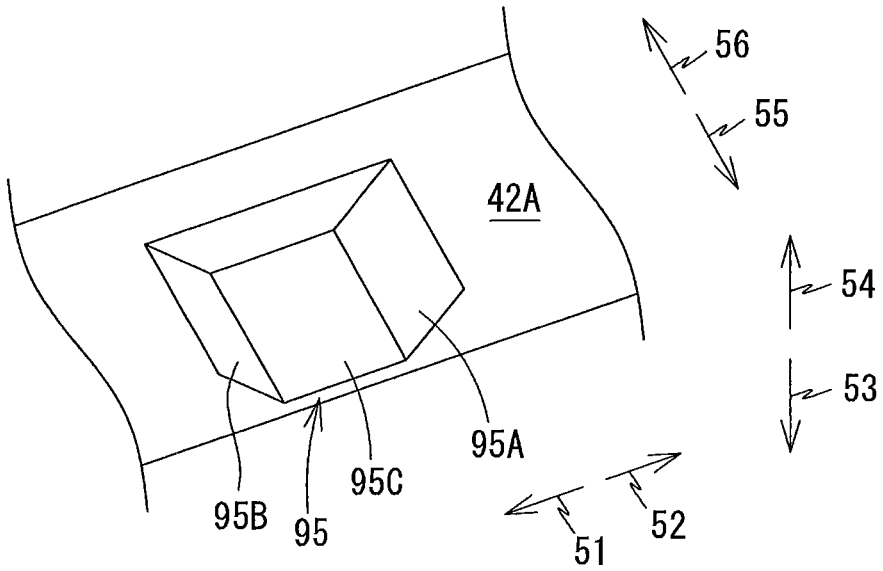
FIG. 6B is a perspective view illustrating configuration in the vicinity of the protruding part of the ink cartridge according to the embodiment in the upright posture.

Further, a downward direction 53 is defined as the direction of gravity, and an upward direction 54 is defined as a direction opposite the direction of gravity. Further, as illustrated in FIGS. 4, 6A and 6B, directions orthogonal to the frontward direction 51 and the downward direction 53 are defined as a rightward direction 55 and a leftward direction 56, respectively. More specifically, when the ink cartridge 30 is in its upright posture (the attached state illustrated in FIG. 1), the rightward direction 55 is defined as a direction extending rightward and the leftward direction 56 as a direction extending leftward when the ink cartridge 30 is viewed from the rear, as illustrated in FIG. 6A.

Further, in the following description, the frontward direction 51 and the rearward direction 52 will be collectively referred to as a front-rear direction, the upward direction 54 and the downward direction 53 are collectively referred to as an up-down direction, and the rightward direction 55 and the leftward direction 56 are collectively referred to as a left-right direction.

In the state where the ink cartridge 30 is completely attached to the cartridge-attachment portion 110, the ink cartridge 30 has a width in the left-right direction (i.e., widthwise direction); a height in the up-down direction (i.e., height direction); and a depth in the front-rear direction (i.e., depth direction).

When the ink cartridge 30 is in its upright posture, the width direction of the ink cartridge 30 corresponds to the left-right direction, the height direction of the ink cartridge 30 corresponds to the up-down direction, and the depth direction of the ink cartridge 30 corresponds to the front-rear direction.

The ink cartridge 30 is inserted frontward into the cartridge-attachment portion 110 through the opening 112 (see FIGS. 7 and 8) while being in the upright posture, and is attached to the cartridge-attachment portion 110 (see FIG. 9). The ink cartridge 30 is extracted rearward from the cartridge-attachment portion 110 while being in the upright posture.

Each ink cartridge 30 stores ink that the printer 10 can use for printing. As illustrated in FIG. 1, each ink cartridge 30 is connected to the recording head 21 by the corresponding ink tube 20 when the ink cartridge 30 is in its attached state in the cartridge-attachment portion 110. The recording head 21 includes sub-tanks 28, and nozzles 29. Each of the sub-tanks 28 temporarily holds ink to be supplied through the corresponding ink tube 20. The recording head 21 ejects ink supplied from the sub-tanks 28 through the nozzles 29 according to an inkjet recording method. More specifically, the recording head 21 includes a head control board (not illustrated), and piezoelectric elements 29A corresponding one-on-one to the nozzles 29. The head control board selectively applies drive voltages to the piezoelectric elements 29A in order to eject ink through the nozzles 29.

In the attached state of the ink cartridges 30 to the cartridge-attachment portion 110, the ink in each ink cartridge 30 can be used for printing by the recording head 21 in the printer 10. Hence, hereinafter, the posture of each ink cartridge 30 in its attached state to the cartridge-attachment portion 110 may also be called as "operational posture", as appropriate.

The printer 10 also includes a sheet tray 15, a feed roller 23, a conveying path 24, a pair of conveying rollers 25, a platen 26, a pair of discharge rollers 27, and a discharge tray 16. The feed roller 23 feeds each of the sheets from the sheet tray 15 onto the conveying path 24, and the conveying rollers 25 convey the sheet onto the platen 26. The recording head 21 ejects ink onto the sheet as the sheet passes over the platen 26, whereby an image is recorded on the sheet. The discharge rollers 27 receive the sheet that has passed over the platen 26 and discharge the sheet into the discharge tray 16 provided on a downstream end of the conveying path 24.

<Cartridge-Attachment Portion 110>

Figure 2:
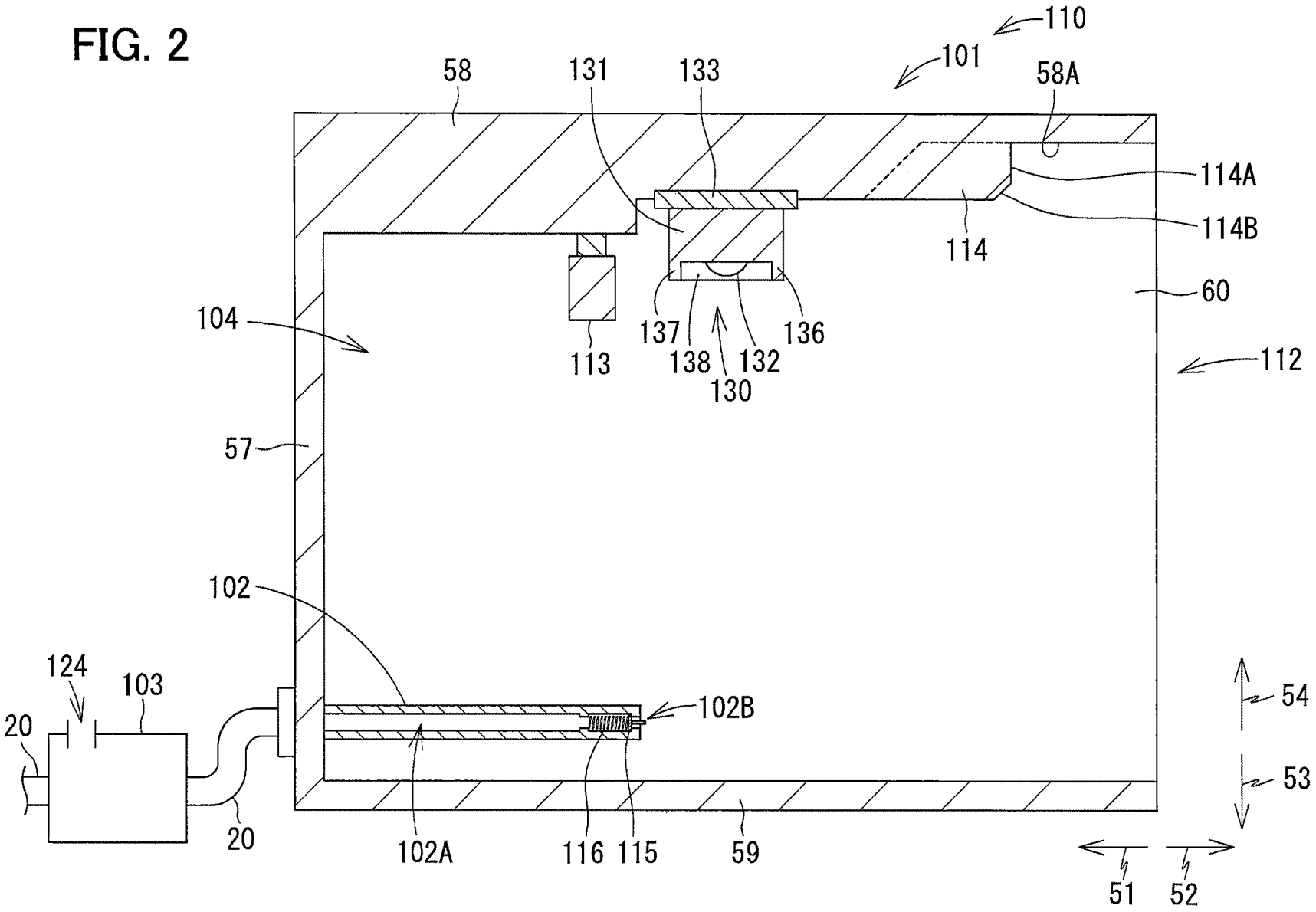
FIG. 2 is a vertical cross-sectional view of a cartridge-attachment portion of the printer according to the embodiment.

As illustrated in FIG. 2, the cartridge-attachment portion 110 includes a cartridge holder 101, a cover 111, a cover sensor 118, tubes 102, tanks 103, optical sensors 113, ribs 114, and connectors 130.

<Cartridge Holder 101>

The cartridge holder 101 illustrated in FIG. 2 constitutes a housing of the cartridge-attachment portion 110. The cartridge holder 101 has a box shape defining an interior space 104 therein.

As illustrated in FIG. 2, the cartridge holder 101 includes an end wall 57, a bottom wall 59, a top wall 58, and a pair of side walls 60. The bottom wall 59 extends rearward from a bottom edge of the end wall 57. The top wall 58 extends rearward from a top edge of the end wall 57 and is separated from the bottom wall 59 in the up-down direction. One of the side walls 60 extends rearward from a right edge of the end wall 57, while the remaining one of the side walls 60 extends from a left edge of the end wall 57. The side wall 60 extending from the right edge of the end wall 57 is connected to a right edge of the bottom wall 59 and a right edge of the top wall 58, and the side wall 60 extending from the left edge of the end wall 57 is connected to a left edge of the bottom wall 59 and a left edge of the top wall 58. Hence, the side walls 60 are separated from each other in the left-right direction and respectively connect the top wall 58 to the bottom wall 59.

An end of the cartridge holder 101 opposite the end wall 57 in the front-rear direction is open and serves as the opening 112. The opening 112 is in communication with the interior space 104 of the cartridge holder 101. A user faces the opening 112 when using the printer 10.

The interior space 104 of the cartridge holder 101 is defined by the end wall 57, the bottom wall 59, the top wall 58, and the side walls 60. Partitioning walls (not illustrated) partition the interior space 104 into four compartments. One of the tubes 102, the tanks 103, the optical sensors 113, the ribs 114, and the connectors 130 is provided in each compartment of the interior space 104. Note that the number of compartments in the interior space 104 is not limited to four.

<Tubes 102>

Each tube 102 illustrated in FIG. 2 is made of resin and has a hollow cylindrical shape. As illustrated in FIG. 2, the tubes 102 are located in a lower portion of the end wall 57 constituting the cartridge holder 101. The tubes 102 protrude farther rearward than the end wall 57 of the cartridge holder 101. A rear end (distal end) and a front end (proximal end) of each tube 102 are both open.

Each tube 102 has an interior space 102A therein. A valve 115 and a coil spring 116 are accommodated in each interior space 102A. The valve 115 is movable in the front-rear direction to open and close an opening 102B formed in the distal end of the tube 102. The coil spring 116 urges the valve 115 rearward. Hence, in a state where no external force is applied to the valve 115 (when the ink cartridge 30 is not mounted in the cartridge-attachment portion 110), the valve 115 closes the opening 102B. When no external force is applied to the valve 115, a rear end of the valve 115 urged by the coil spring 116 protrudes out of the opening 102B to extend further rearward than the opening 102B.

Notches (not illustrated) are formed in a peripheral wall of each tube 102 at a distal end thereof, and specifically in a portion of the peripheral wall positioned rearward from a part of the valve 115 that closes the opening 102B, i.e., a front end of the valve 115.

<Cover 111>

As illustrated in FIG. 1, the cover 111 is provided near the opening 112 formed in the cartridge holder 101. The cover 111 is capable of covering the opening 112 or exposing the opening 112 to the outside by closing and opening on the cartridge holder 101. The cover 111 is supported on a pivot shaft 109 that extends in the left-right direction near a portion of the cartridge holder 101 defining a bottom edge of the opening 112. With this configuration, the cover 111 is capable of pivoting from a closed position (see FIG. 1) for covering the opening 112 to an open position so that a top edge of the cover 111 moves rearward. When the cover 111 is in the open position, the user can insert ink cartridges 30 into the cartridge holder 101 through the opening 112 formed in the cartridge holder 101. When the cover 111 is in the closed position, the user cannot insert ink cartridges 30 into or extract ink cartridges 30 from the cartridge holder 101.

<Tanks 103>

As illustrated in FIG. 2, the tanks 103 are provided frontward of the cartridge holder 101. Each tank 103 has a box shape that allows ink to be stored therein. Each tank 103 has a top portion that is open to the outside through an air communication port 124. Accordingly, an interior space of the tank 103 is in communication with the atmosphere. The interior space in the tank 103 is in communication with the front end of the corresponding tube 102 via the corresponding ink tube 20. With this arrangement, ink flowing out of the interior space 102A of the tube 102 is accumulated in the tank 103. The interior space of the tank 103 is also in communication with the recording head 21 through the corresponding ink tube 20. Accordingly, ink stored in the internal space of the tank 103 is supplied to the recording head 21 through the corresponding ink tube 20.

Note that the cartridge-attachment portion 110 need not be provided with the tanks 103. In this case, the rear ends of the tubes 102 communicate with the recording head 21 via the ink tubes 20 without passing through the tanks 103.

<Optical Sensors 113>

As illustrated in FIG. 2, the optical sensors 113 are disposed near the top wall 58 of the cartridge holder 101. Each optical sensor 113 includes a light-emitting part and a light-receiving part. The light-emitting part is disposed on the right or left of the light-receiving part and is spaced away from the light-receiving part.

The optical sensors 113 are configured to output detection signals to a controller 1 (see FIG. 1). The signals differ depending on whether the light-receiving parts receive light emitted in the left-right direction from the corresponding light-emitting parts. For example, the optical sensor 113 outputs a low level signal to the controller 1 when the light-receiving part cannot receive light emitted from the corresponding light-emitting part (that is, when the received light is less than a prescribed intensity); and the optical sensor 113 outputs a high level signal to the controller 1 when the light-receiving part can receive light emitted from the corresponding light-emitting part (that is, when the received light is greater than or equal to the prescribed intensity). Here, the controller 1 is a device for controlling overall operations of the printer 10 and is configured of a CPU, ROM, and RAM, for example.

<Cover Sensor 118>

As illustrated in FIG. 1, the cover sensor 118 is disposed on the cartridge holder 101 near the top edge of the opening 112. The cover sensor 118 includes a light-emitting part and a light-receiving part. When the cover 111 is in the closed position, a part of the cover 111 is disposed in an optical path of the light traveling from the light-emitting part toward the light-receiving part, blocking the light from reaching the light-receiving part in the cover sensor 118. Accordingly, the cover sensor 118 outputs a low level signal to the controller 1. When the cover 111 is not in the closed position, that is, when the cover 111 is separated from the cover sensor 118, the cover 111 does not interrupt the light traveling from the light-emitting part to the light-receiving part. The cover sensor 118 thus outputs a high level signal to the controller 1.

<Ribs 114>

Figure 10:
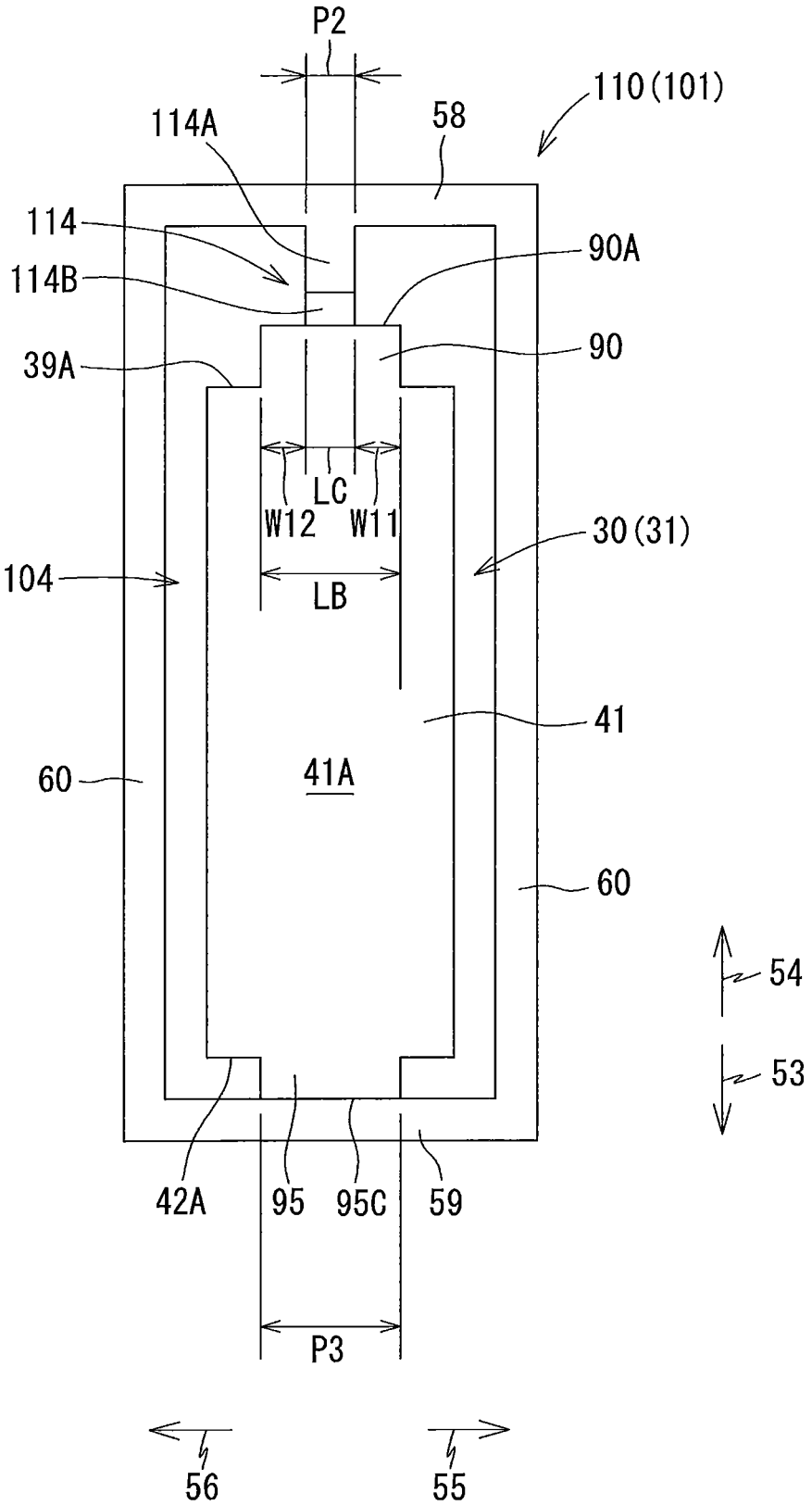
FIG. 10 is a rear side view of the ink cartridge according to the embodiment and the cartridge-attachment portion illustrated in FIG. 9.

As illustrated in FIG. 2, the ribs 114 are disposed on the top wall 58 at positions further rearward than the optical sensors 113. Each rib 114 protrudes downward from the top wall 58 and extends in the front-rear direction. As illustrated in FIG. 10, one of the ribs 114 is disposed at the center portion of the top wall 58 in the left-right direction in each of the four compartments of the interior space 104 defined in the cartridge holder 101. As illustrated in FIG. 2, each rib 114 has a surface 114A facing rearward. The surface 114A has a lower portion serving as an inclined surface 114B that extends upward while extending rearward. Note that the entire portion of the surface 114A may function as the inclined surface 114B.

<Connectors 130>

Figure 3A:
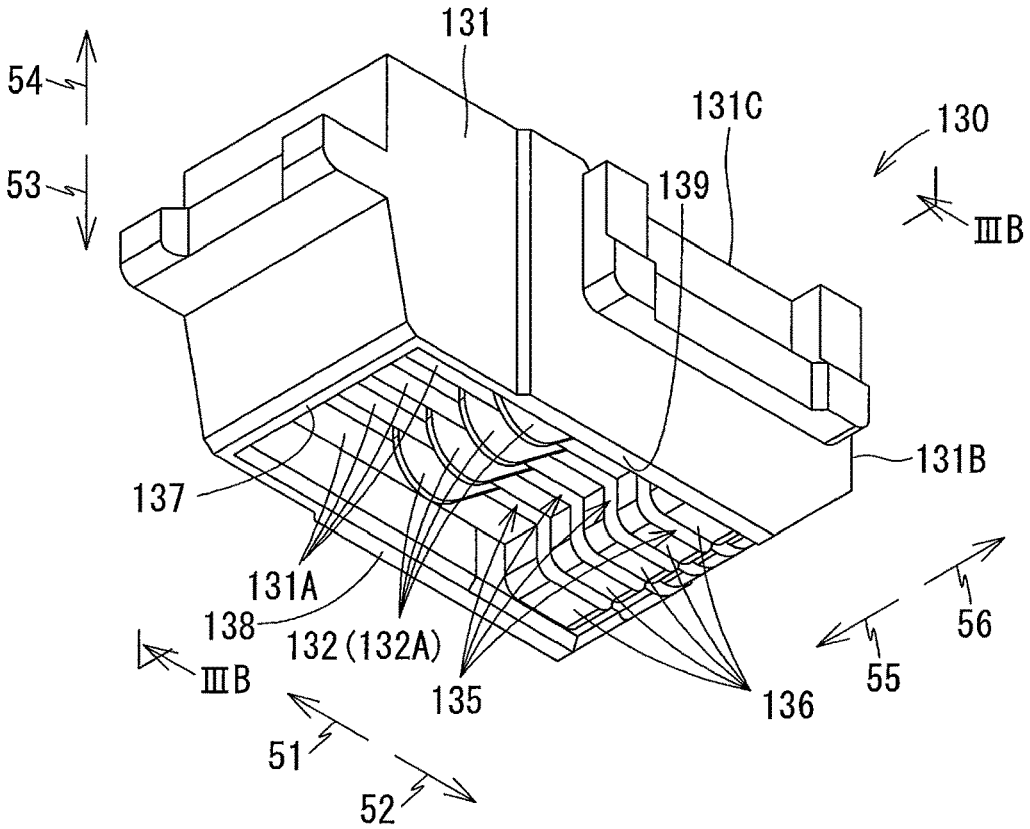
FIG. 3A is a perspective view illustrating a connector of the cartridge-attachment portion of the printer according to the embodiment.
Figure 3B:
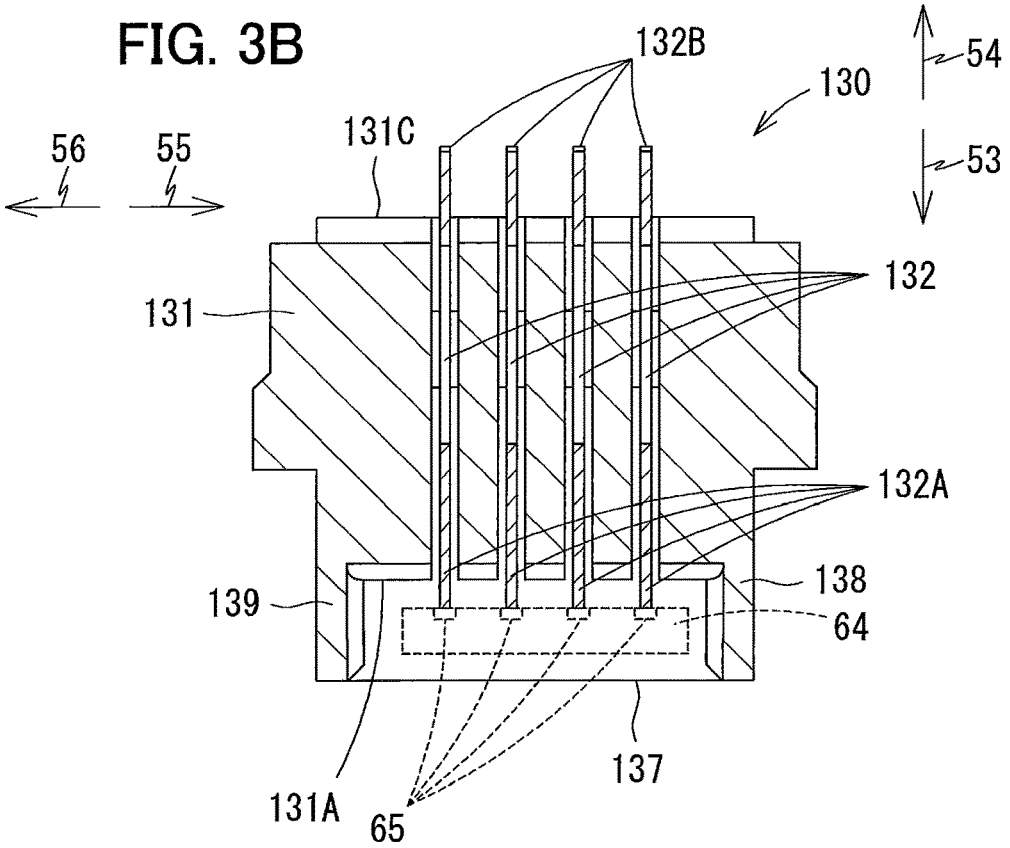
FIG. 3B is a cross-sectional view of the connector of the cartridge-attachment portion of the printer according to the embodiment taken along a plane IIIB-IIIB in FIG. 3A.

As illustrated in FIGS. 2 through 3B, each connector 130 includes four contacts 132, and a case 131 accommodating the contacts 132.

As illustrated in FIG. 2, a circuit board 133 is fixed to the cartridge holder 101 near the top wall 58. The circuit board 133 is positioned farther rearward than the tubes 102 and the optical sensors 113 and farther frontward than the ribs 114. In other words, the circuit board 133 is fixed to the cartridge holder 101. The cases 131 of the connectors 130 are fixed to a bottom surface of the circuit board 133 with screws, solder, or the like (not illustrated). Hence, the connectors 130 are fixed to the top wall 58 of the cartridge holder 101 via the circuit board 133. Note that the connectors 130 need not be fixed to the cartridge holder 101. Alternatively, the connectors 130 may be detachably attached to the bottom surface of the circuit board 133 by engaging the connectors 130 with the circuit board 133, for example.

As illustrated in FIGS. 3A and 3B, the case 131 of each connector 130 has a generally rectangular parallelepiped shape. Slots 135 are formed in the case 131 from a bottom surface 131A to a top surface 131C via a rear surface 131B. Four of the slots 135 are formed at intervals in the left-right direction. The four slots 135 provide four internal spaces in the case 131. One of the contacts 132 is disposed in each of the four internal spaces. Thus, the connector 130 includes four contacts 132. Note that the number of slots 135 is not limited to four, and thus the number of contacts 132 provided in the connector 130 is not limited to four, either.

The contacts 132 are supported by the case 131 in the corresponding internal spaces formed by the slots 135. The contacts 132 are configured of members that are flexible and electrically conductive. Bottom end portions 132A of the contacts 132 protrude farther downward than the bottom surface 131A of the case 131. The bottom end portions 132A of the contacts 132 are resiliently deformable upward.

Top end portions 132B of the contacts 132 (see FIG. 3B) are mounted on the circuit board 133. Through this construction, the contacts 132 are electrically connected to an electrical circuit mounted on the circuit board 133. In other words, the contacts 132 are electrically connected to the electrical circuit. The electrical circuit is also electrically connected to the controller 1 (see FIG. 1).

The case 131 includes a rear wall 136, a front wall 137, a right wall 138, and a left wall 139. The rear wall 136, the front wall 137, the right wall 138, and the left wall 139 protrude downward from the bottom surface 131A of the case 131. Bottom edges of the rear wall 136, the front wall 137, the right wall 138, and the left wall 139 are positioned lower than bottom edges of the contacts 132.

The rear wall 136 is positioned farther rearward than the bottom end portions 132A of the contacts 132. The front wall 137 is positioned farther frontward than the bottom end portions 132A of the contacts 132. The rear wall 136 and the front wall 137 are aligned with each other in the front-rear direction. The right wall 138 is positioned farther rightward than the bottom end portions 132A of the contacts 132, and the left wall 139 is positioned farther leftward than the bottom end portions 132A of the contacts 132. The right wall 138 and the left wall 139 are aligned with each other in the left-right direction. A front edge of the right wall 138 is connected to a right edge of the front wall 137, and a rear edge of the right wall 138 is connected to a right edge of the rear wall 136. A front edge of the left wall 139 is connected to a left edge of the front wall 137, and a rear edge of the left wall 139 is connected to a left edge of the rear wall 136.

<Ink Cartridge 30>

The ink cartridge 30 illustrated in FIGS. 4 to 6B is a container for storing ink. One ink cartridge 30 can be accommodated in each of the four compartments partitioned in the interior space 104 of the cartridge holder 101 (see FIG. 2). Thus, four ink cartridges 30 can be accommodated in the cartridge-attachment portion 110 in the present embodiment. Each of the four ink cartridges 30 corresponds to one of the ink colors of cyan, magenta, yellow, and black. Ink in one of these four colors is stored in the corresponding ink cartridge 30. The number of ink cartridges 30 that the cartridge-attachment portion 110 can accommodate is not limited to four.

As illustrated in FIGS. 4 to 6B, each ink cartridge 30 includes a housing 31, a sealing member 76, a projection 67, a resilient member 90, a protruding part 95, a recessed portion 43, a support member 44, a coil spring 45, and a circuit board 64. Unless otherwise specified, hereinafter, the ink cartridge 30 is assumed to be in its upright posture (operational posture). In other words, the up-down direction, the front-rear direction, and the left-right direction for the ink cartridge 30 are defined based on the ink cartridge 30 being in the upright posture (operational posture).

The housing 31 is configured of a front wall 40, a rear wall 41, a top wall 39, a bottom wall 42, and a pair of side walls 37 and 38. The front wall 40 and the rear wall 41 are separated from each other in the front-rear direction. The top wall 39 is arranged between the front wall 40 and the rear wall 41 and extends from a top edge of the front wall 40 to a top edge of the rear wall 41. The bottom wall 42 is arranged between the front wall 40 and the rear wall 41 and extends from a bottom edge of the front wall 40 to a bottom edge of the rear wall 41. That is, the top wall 39 and the bottom wall 42 respectively connect the front wall 40 to the rear wall 41. The top wall 39 and the bottom wall 42 are spaced away from each other in the direction of gravity. The side wall 37 and the side wall 38 are separated from each other in the left-right direction. Peripheral edges of the side walls 37 and 38 are connected to the front wall 40, the rear wall 41, the top wall 39, and the bottom wall 42, respectively.

In a state where the ink cartridge 30 is in its upright posture, a direction from the rear wall 41 to the front wall 40 is equivalent to the frontward direction 51, a direction from the front wall 40 to the rear wall 41 is equivalent to the rearward direction 52, a direction from the top wall 39 to the bottom wall 42 is equivalent to the downward direction 53, a direction from the bottom wall 42 to the top wall 39 is equivalent to the upward direction 54, a direction from the side wall 38 to the side wall 37 is equivalent to the rightward direction 55, and a direction from the side wall 37 to the side wall 38 is equivalent to the leftward direction 56. Also in the upright posture, a front surface 40A of the front wall 40 faces frontward, a rear surface 41A of the rear wall 41 faces rearward, a bottom surface 42A of the bottom wall 42 faces downward, a top surface 39A of the top wall 39 faces upward, a right surface 37A of the side wall 37 faces rightward, and a left surface 38A of the side wall 38 faces leftward.

The front wall 40 is configured of a front wall 40B, and a front wall 40C positioned farther rearward than the front wall 40B. That is, a front surface of the front wall 40B and a front surface of the front wall 40C constitute the front surface 40A of the front wall 40.

The bottom wall 42 is configured of a bottom wall 42B, and a bottom wall 42C positioned higher than the bottom wall 42B. A bottom surface of the bottom wall 42B and a bottom surface of the bottom wall 42C constitute the bottom surface 42A of the bottom wall 42. The bottom wall 42C extends continuously rearward from a bottom edge of the front wall 40B. The bottom wall 42B and the bottom wall 42C are joined through the front wall 40C.

The ink cartridge 30 has an overall flattened shape in which a left-right dimension thereof (width) is smaller than a front-rear dimension thereof (depth), and the up-down dimension and the front-rear dimension (height and depth) are greater than the left-right dimension (width).

The ink cartridge 30 is configured to be attached to the cartridge holder 101 by inserting the ink cartridge 30 frontward through the opening 112 formed in the cartridge holder 101 of the cartridge-attachment portion 110. The ink cartridge 30 is configured to be removed from the cartridge holder 101 by pulling the ink cartridge 30 rearward through the opening 112.

Figure 5:
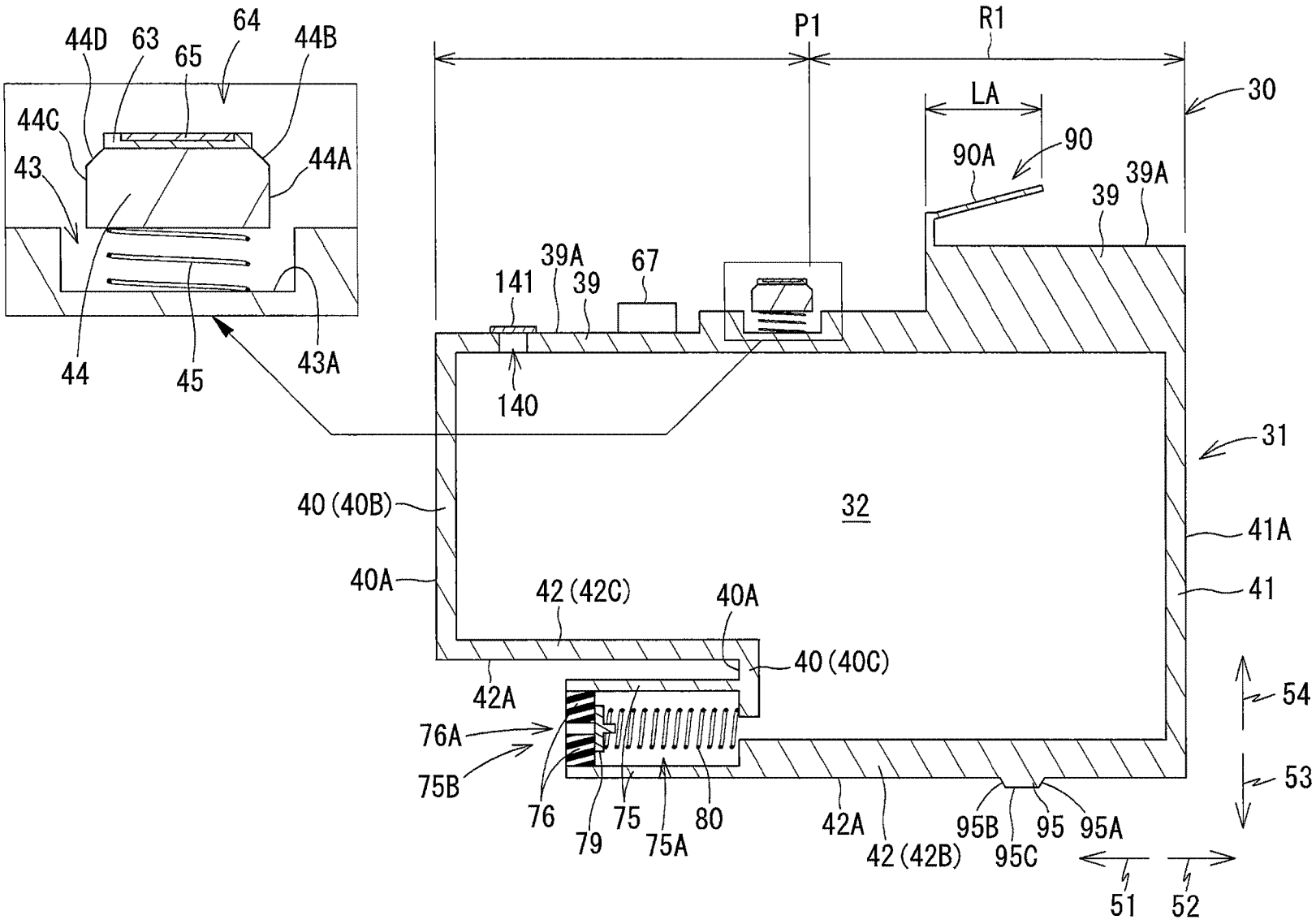
FIG. 5 is a vertical cross-sectional view of the ink cartridge according to the embodiment in the upright posture.

As illustrated in FIG. 5, the housing 31 defines therein a storage chamber 32 for storing ink. The storage chamber 32 is positioned between the front wall 40 and the rear wall 41, between the top wall 39 and the bottom wall 42, and between the pair of side walls 37 and 38. In the present embodiment, the storage chamber 32 is defined by a surface of the front wall 40 opposite the front surface 40A (a rear surface of the front wall 40), a surface of the rear wall 41 opposite the rear surface 41A (a front surface of the rear wall 41), a surface of the top wall 39 opposite the top surface 39A (a lower surface of the top wall 39), a surface of the bottom wall 42 opposite the bottom surface 42A (an upper surface of the bottom wall 42), a surface of the side wall 37 opposite the right surface 37A (a left surface of the side wall 37), and a surface of the side wall 38 opposite the left surface 38A (a right surface of the side wall 38).

In the housing 31, at least the rear wall 41 is capable of transmitting light so that a level of ink stored in the storage chamber 32 is visible from the outside of the housing 31.

The housing 31 also includes a cylinder 75 that protrudes frontward from the front surface 40A of the front wall 40C. The cylinder 75 extends in the front-rear direction. The cylinder 75 defines therein a passage 75A extending in the front-rear direction. That is, the direction in which the cylinder 75 and the passage 75A extend (front-rear direction) coincides with the insertion direction of the ink cartridge 30. The passage 75A has a rear end in communication with the storage chamber 32. An opening 75B is formed in a front end of the cylinder 75 and in communication with the passage 75A. That is, the passage 75A is provided at the front wall 40C to be open frontward. In other words, the passage 75A penetrates the front wall 40C in the front-rear direction and provides communication between the storage chamber 32 and the outside of the housing 31.

A valve 79 and a coil spring 80 are accommodated inside the passage 75A. The valve 79 is movable in the front-rear direction to open and close the opening 75B. The coil spring 80 urges the valve 79 frontward. Therefore, in a state where no external force is applied to the valve 79, the valve 79 firmly contacts the sealing member 76 fitted in the opening 75B. When an external force is applied to the valve 79, the valve 79 is separated from the sealing member 76, thereby bringing the passage 75A into communication with the outside of the housing 31. Accordingly, ink stored in the storage chamber 32 can be supplied to the outside of the housing 31 through the passage 75A and the opening 75B. Incidentally, a structure for switching between opening and closing of the opening 75B is not limited to the structure configured of the valve 79. For example, the opening 75B may be closed by a seal affixed to the cylinder 75.

An air communication port 140 is formed in the top wall 39 of the housing 31. In a state prior to insertion of the ink cartridge 30 into the cartridge-attachment portion 110, the air communication port 140 is sealed with a seal 141. The seal 141 can be peeled off the air communication port 140. By peeling the seal 141 off the air communication port 140 before insertion of the ink cartridge 30 into the cartridge-attachment portion 110, the storage chamber 32 is able to communicate with the atmosphere via the air communication port 140.

Incidentally, the storage chamber 32 may be communicated with the atmosphere through means not involving peeling off of the seal 141. For example, a valve may be provided in the air communication port 140 so as to realize switching of a status of the storage chamber 32 between a communication state in communication with the atmosphere and a non-communication state out of communication with the atmosphere.

Incidentally, the front wall 40, the rear wall 41, the top wall 39, the bottom wall 42, the side wall 37, and the side wall 38 each may be configured of a plurality of walls in the same manner as the front wall 40 in the embodiment, or each may be configured of a single wall just like the rear wall 41.

Still alternatively, the surfaces of the ink cartridge 30 including the front surface 40A of the front wall 40, the rear surface 41A of the rear wall 41, the top surface 39A of the top wall 39, the bottom surface 42A of the bottom wall 42, the right surface 37A of the side wall 37, and the left surface 38A of the side wall 38 need not be formed as single flat surfaces, respectively.

The front surface 40A of the front wall 40 is a surface of the housing 31 that the user can see when the ink cartridge 30 in its upright posture is viewed from the front side. According to a concept of the present disclosure, a front surface includes: a surface of the housing 31 positioned farthest frontward (the front surface 40A); and a surface positioned frontward of a halfway point in the front-rear direction between the forwardmost surface and a rearmost surface of the housing 31 (the rear surface 41A).

The rear surface 41A of the rear wall 41 is a surface of the housing 31 that the user can see when the ink cartridge 30 in its upright posture is viewed from the rear side. The concept of a rear surface in the present disclosure includes: a surface of the housing 31 positioned farthest rearward (the rear surface 41A); and a surface positioned rearward of the halfway point in the front-rear direction between the rearmost surface and the frontwardmost surface of the housing 31 (front surface 40A).

The top surface 39A of the top wall 39 is a surface of the housing 31 that the user can see when the ink cartridge 30 in its upright posture is viewed from above. The concept of the top surface in the present disclosure includes: a topmost surface of the housing 31 (the top surface 39A); and a surface above a vertical halfway point between this topmost surface and a bottommost surface of the housing 31 (the bottom surface 42A).

The bottom surface 42A of the bottom wall 42 is a surface of the housing 31 that the user can see when the ink cartridge 30 in its upright posture is viewed from below. The concept of the bottom surface in the present disclosure includes: the bottommost surface of the housing 31 (the bottom surface 42A); and a surface below the vertical halfway point between this bottommost surface and the topmost surface of the housing 31 (the top surface 39A).

The right surface 37A of the side wall 37 is a surface of the housing 31 that the user can see when the ink cartridge 30 in its upright posture is viewed from the right side.

The left surface 38A of the side wall 38 is a surface of the housing 31 that the user can see when the ink cartridge 30 in its upright posture is viewed from the left side.

<Sealing Member 76>

As illustrated in FIG. 5, the sealing member 76 is disposed in the passage 75A. The sealing member 76 is configured of an elastic member such as rubber. The sealing member 76 is a ring-shaped member with a through-hole 76A formed in a center thereof. The through-hole 76A has a circular shape in cross-section. The through-hole 76A has a diameter smaller than an outer diameter of the corresponding tube 102 in the cartridge-attachment portion 110 (see FIG. 2). As illustrated in FIG. 5, the sealing member 76 is disposed near the opening 75B of the cylinder 75 so that the through-hole 76A is aligned with the opening 75B in the front-rear direction. The sealing member 76 has an outer diameter larger than a diameter of the opening 75B. Accordingly, when the sealing member 76 is fitted in the opening 75B, a hermetic seal is formed between the sealing member 76 and the cylinder 75 to provide a liquid-tight seal therebetween.

The sealing member 76 is prevented from coming off the cylinder 75 by well-known means. For example, the sealing member 76 may be fixed in the cylinder 75 by nipping the sealing member 76 between the cylinder 75 and a cap (not illustrated) placed over the cylinder 75, or may be fixed in the cylinder 75 by adhesive.

<Projection 67>

As illustrated in FIGS. 4 and 5, the projection 67 is provided on the top surface 39A of the top wall 39. The projection 67 protrudes upward from the top surface 39A and is elongated in the front-rear direction.

Light emitted by the optical sensor 113 of the cartridge-attachment portion 110 (see FIG. 2) is configured to be incident on either a right surface or a left surface of the projection 67. Hence, the surface of the projection 67 on which light is incident will be called a "light-blocking surface". In the present embodiment, the projection 67 is a plate formed of a resin material that contains a color material (black pigment) capable of blocking or attenuating light, for example. As a variation, a material that prevents passage of light such as aluminum foil may be affixed to at least the light-blocking surface of the projection 67.

<Resilient Member 90>

As illustrated in FIGS. 4 and 5, the resilient member 90 is disposed on the top surface 39A of the top wall 39 at a position further rearward than the projection 67. Here, an intermediate position P1 of the housing 31 is defined by a front end of the housing 31 (frontmost portion of the front surface 40A) and a rear end of the housing 31 (rearmost portion of the rear surface 41A) in the front-rear direction. The resilient member 90 is positioned in an area R1 which is an area that is further rearward than the intermediate position P1 (i.e., an area between the intermediate position P1 and the rear end of the housing 31 in the front-rear direction). As illustrated in FIGS. 4 to 6A, the resilient member 90 protrudes upward from the top surface 39A and extends upward while extending in the rearward direction.

The resilient member 90 is a member that is resiliently deformable. In the present embodiment, the resilient member 90 is a leaf spring whose dimension in the front-rear direction is greater than a dimension in the up-down direction. When an external force is applied to the resilient member 90, the resilient member 90 is resiliently deformed in the up-down direction to be bent so that a distal end portion (rear end portion) of the resilient member 90 is moved in the up-down direction.

The resilient member 90 has a top surface 90A facing diagonally upward and frontward. In other words, the top surface 90A faces in the upward direction and the frontward direction. The top surface 90A is positioned further upward than the storage chamber 32. The top surface 90A has a dimension LA (see FIG. 5) in the front-rear direction greater than a dimension LB (see FIG. 10) in the left-right direction. That is, the top surface 90A is elongated in the front-rear direction. The dimension LB (see FIG. 10) in the left-right direction of the top surface 90A is greater than a distance LC (see FIG. 10) in the left-right direction of the rib 114. Note that the dimension LA may be smaller than or equal to the dimension LB, and the dimension LB may be smaller than or equal to the dimension LC.

Incidentally, in FIG. 10, only one of four spaces defined by partitioning the interior space 104 is illustrated, while the remaining three of the four spaces is omitted.

<Protruding Part 95>

As illustrated in FIGS. 4, 5 and 6B, the protruding part 95 protrudes downward from the bottom surface 42A of the bottom wall 42. In the front-rear direction, the protruding part 95 is disposed in the area R1 that is positioned further rearward than the intermediate position P1. When the ink cartridge 30 is viewed in the up-down direction (i.e., in the plan view of the ink cartridge 30), the protruding part 95 has at least a portion overlapped with the resilient member 90. The protruding part 95 has a rear surface 95A inclined relative to the front-rear direction so as to extend upward toward rearward, and a front surface 95B inclined relative to the front-rear direction so as to extend upward toward frontward.

A bottom surface 95C of the protruding part 95 is positioned between the rear surface 95A and the front surface 95B in the front-rear direction. A rear end of the bottom surface 95C is connected to a front end of the rear surface 95A. A front end of the bottom surface 95C is connected to a rear end of the front surface 95B. The bottom surface 95C faces downward and is positioned further downward than the storage chamber 32. That is, the bottom surface 95C is positioned opposite to the resilient member 90 with respect to the storage chamber 32 in the up-down direction.

<Circuit Board 64>

As illustrated in FIGS. 4 to 6A, the top wall 39 is formed with the recessed portion 43 that is recessed downward from the top surface 39A. The recessed portion 43 is formed at a position further rearward than the projection 67 and further frontward than the resilient member 90. The coil spring 45 is disposed inside the recessed portion 43. The coil spring 45 has a bottom end connected to a bottom surface 43A of the recessed portion 43, and a top end connected to a bottom surface of the support member 44. The support member 44 has a substantially rectangular parallelepiped shape in the present embodiment, but may have a shape other than the rectangular parallelepiped shape.

A rear surface 44A of the support member 44 has at least a portion (an upper portion of the rear surface 44A in the present embodiment) serving as an inclined surface 44B inclined relative to the front-rear direction. That is, the inclined surface 44B extends downward toward rearward. Further, a front surface 44C of the support member 44 has at least a portion (an upper portion of the front surface 44C in the present embodiment) serving as an inclined surface 44D inclined relative to the front-rear direction. In other words, the inclined surface 44D extends downward toward frontward. Note that the entire portion of the rear surface 44A may serve as the inclined surface 44B, and the entire portion of the front surface 44C may serve as the inclined surface 44D. The circuit board 64 is supported to a top surface of the support member 44.

A rear surface of the circuit board 64 may be inclined as similar to the inclined surface 44B, and a front surface of the circuit board 64 may be inclined as similar to the inclined surface 44D.

The circuit board 64 includes a substrate 63, and a plurality (four) of electrodes 65. The substrate 63 is a rigid substrate formed of glass epoxy or the like. The four electrodes 65 and a memory (not illustrated) are mounted on the substrate 63 to constitute the circuit board 64. The number of electrodes 65 depends on the number of contacts 132 (see FIG. 2) of the cartridge-attachment portion 110. That is, the number of electrodes 65 is not limited to four. Incidentally, the substrate 63 may be configured of a flexible substrate having flexibility.

The substrate 63 is bonded to the top surface of the support member 44 with a photopolymer. Here, the circuit board 64 (the substrate 63) may be bonded to the top surface of the support member 44 with an adhesive other than a photopolymer, or may be fixed to the top surface of the support member 44 by means other than adhesives, such as thermal caulking. Alternatively, the circuit board 64 may be fixed to the top surface of the support member 44 by means other than adhesion.

The memory of the circuit board 64 stores information related to the ink cartridge 30 that can be read by the controller 1 of the printer 10. The information related to the ink cartridge 30 may be data specifying a lot number, a manufactured date, an ink color, and the like. Incidentally, a battery may be mounted on the substrate 63. In this case, the battery is electrically connected to the memory to supply electric power to the memory.

As illustrated in FIG. 3B, the four electrodes 65 formed on the substrate 63 corresponds to the four contacts 132 in the cartridge-attachment portion 110 in one-to-one-correspondence. That is, the number of the electrodes 65 is not limited to four as similar to the contacts 132, as described above. As illustrated in FIGS. 4 and 6A, the electrodes 65 extend in the front-rear direction and arranged to be spaced apart from one another in the left-right direction. Each of the electrodes 65 is electrically connected to the memory.

The circuit board 64 is movable between a first position (the position illustrated in FIGS. 4 and 5) and a second position (not illustrated) due to expansion and contraction of the coil spring 45 in the up-down direction, i.e., the resilient deformation of the coil spring 45 in the up-down direction. When in the second position, the circuit board 64 is positioned further downward than that in the first position. In other words, the support member 44 in the second position of the circuit board 64 is further inserted into the recessed portion 43 than that in the first position of the circuit board 64.

In a state where the coil spring 45 has a natural length, the circuit board 64 is in the first position. The coil spring 45 is compressed than its natural length when the circuit board 64 is in the second position. That is, when the coil spring 45 is compressed than its natural length, the coil spring 45 urges the support member 44 and the circuit board 64 upward, i.e., toward the first position of the circuit board 64.

<Operations for Attaching the Ink Cartridge 30 to the Cartridge-Attachment Portion 110>

Next, operations for mounting the ink cartridge 30 in the cartridge holder 101 of the cartridge-attachment portion 110 will be described.

FIGS. 4 and 5 illustrates the ink cartridge 30 prior to being mounted in the cartridge-attachment portion 110. At this time, the seal 141 seals the air communication port 140 so that the storage chamber 32 is not in communication with the atmosphere. Prior to mounting the ink cartridge 30 in the cartridge-attachment portion 110, the user peels off the seal 141, thereby opening the storage chamber 32 to the atmosphere. Also, prior to the ink cartridge 30 being mounted in the cartridge-attachment portion 110, the valve 79 is in intimate contact with the sealing member 76. Consequently, ink stored in the storage chamber 32 is prevented from flowing out of the ink cartridge 30 through the through-hole 76A.

In a state where the ink cartridge 30 is not attached to the cartridge-attachment portion 110 as illustrated in FIG. 2, nothing is positioned between the light-emitting part and light-receiving part of the optical sensor 113. Hence, light is allowed to travel from the light-emitting part to the light-receiving part. At this time, the optical sensor 113 outputs a high level detection signal to the controller 1 (see FIG. 1). Further, prior to attachment of the ink cartridge 30 to the cartridge-attachment portion 110, the valve 115 closes the opening 102B, and the rear end of the valve 115 protrudes further rearward than the opening 102B.

Figure 7:
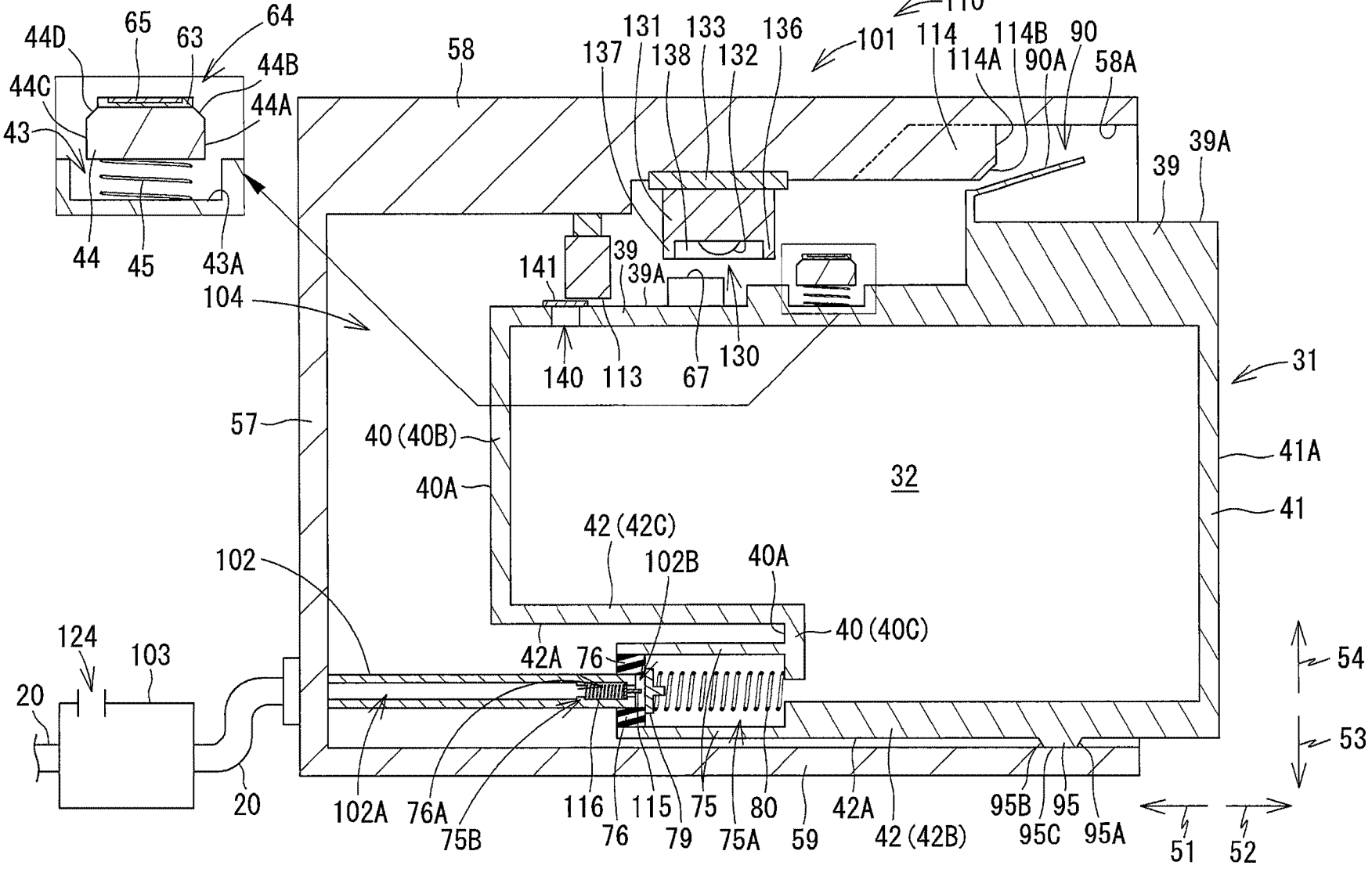
FIG. 7 is a vertical cross-sectional view illustrating a state where the ink cartridge according to the embodiment is inserted into the cartridge-attachment portion.

In order to attach the ink cartridge 30 to the cartridge-attachment portion 110, the user inserts the ink cartridge 30 frontward into the cartridge holder 101 through the opening 112 of the cartridge-attachment portion 110 (see FIG. 7). In the present embodiment, the ink cartridge 30 is inserted into the cartridge holder 101 in the upright posture. However, the ink cartridge 30 may instead be inserted into the cartridge holder 101 in an inclined posture inclined relative to the horizontal direction.

As the ink cartridge 30 is inserted frontward into the cartridge holder 101 as illustrated in FIG. 7, the tube 102 of the cartridge-attachment portion 110 penetrates the through-hole 76A of the sealing member 76 (opening 75B) to be inserted into the passage 75A of the cylinder 75. At this time, the outer circumferential surface of the tube 102 closely contacts an inner circumferential surface of the sealing member 76 (the surface defining the through-hole 76A). This configuration not only forms a liquid-tight seal between the cylinder 75 and the tube 102 that prevents ink from leaking into the cartridge holder 101, but also fixes the position of the cylinder 75 relative to the cartridge holder 101.

The tube 102 inserted in the passage 75A also contacts and pushes the valve 79 rearward. Through this action, the valve 79 is separated from the sealing member 76 against a frontward urging force of the coil spring 80 (see FIG. 8).

Further, while the distal end of the tube 102 contacts the valve 79, the valve 79 contacts the valve 115 from a rear side thereof and pushes the valve 115 frontward. Consequently, the valve 115 moves frontward against the urging force of the coil spring 116. Through this action, the interior space 102A of the tube 102 is made in communication with the outside of the tube 102 through the opening 102B.

As a result, the ink stored in the storage chamber 32 can flow into the tank 103 and the recording head 21 via the interior space 102A of the tube 102. At this time (in the state illustrated in FIG. 8), the circuit board 64 is not yet in contact with the cartridge-attachment portion 110.

The ink cartridge 30 is inserted frontward into the cartridge holder 101 while the protruding part 95 is supported to the bottom wall 59. When the ink cartridge 30 is inserted frontward into the cartridge holder 101 while the bottom surface 42A of the bottom wall 42 is supported to the bottom wall 59 (i.e., in a state prior to the protruding part 95 being supported to the bottom wall 59), the protruding part 95 contacts a rear end of the bottom wall 59 from a rear side thereof. At this time, the rear end of the bottom wall 59 is guided relatively by the front surface 95B of the protruding part 95, thereby bringing the protruding part 95 onto the bottom wall 59. As a result, the protruding part 95 is supported to the bottom wall 59.

As the ink cartridge 30 is further inserted frontward into the cartridge holder 101 from the state in FIG. 7, the inclined surface 44D of the support member 44 is brought into abutment against the rear wall 136 from the rear side thereof. Then, when the ink cartridge 30 is further inserted frontward from the above state, the rear wall 136 is guided relatively by the inclined surface 44D due to a reaction force applied to the inclined surface 44D by the rear wall 136. Accordingly, the circuit board 64 and the support member 44 is moved downward against the urging force of the coil spring 45 such that the circuit board 64 is moved from the first position toward the second position. This movement causes the support member 44 and the circuit board 64 to be positioned further downward than the rear wall 136, as illustrated in FIG. 8.

Further, as the ink cartridge 30 is further inserted frontward into the cartridge holder 101 from the state in FIG. 7, the top surface 90A of the resilient member 90 abuts against the surface 114A (the inclined surface 114B) of the rib 114 from rearward. As the ink cartridge 30 is still further inserted frontward, the top surface 90A is guided relatively by the surface 114A due to a reaction force applied to the top surface 90A by the surface 114A so that the resilient member 90 is resiliently deformed. More specifically, the resilient member 90 is resiliently deformed such that the distal end portion (the rear end portion) of the resilient member 90 is moved downward. That is, the resilient member 90 is compressed downward due to its resilient deformation compared to a state where the resilient member 90 is not resiliently deformed. As illustrated in FIG. 8, the resilient member 90 which is resiliently deformed has a curved shape that is convexed upward.

Figure 8:
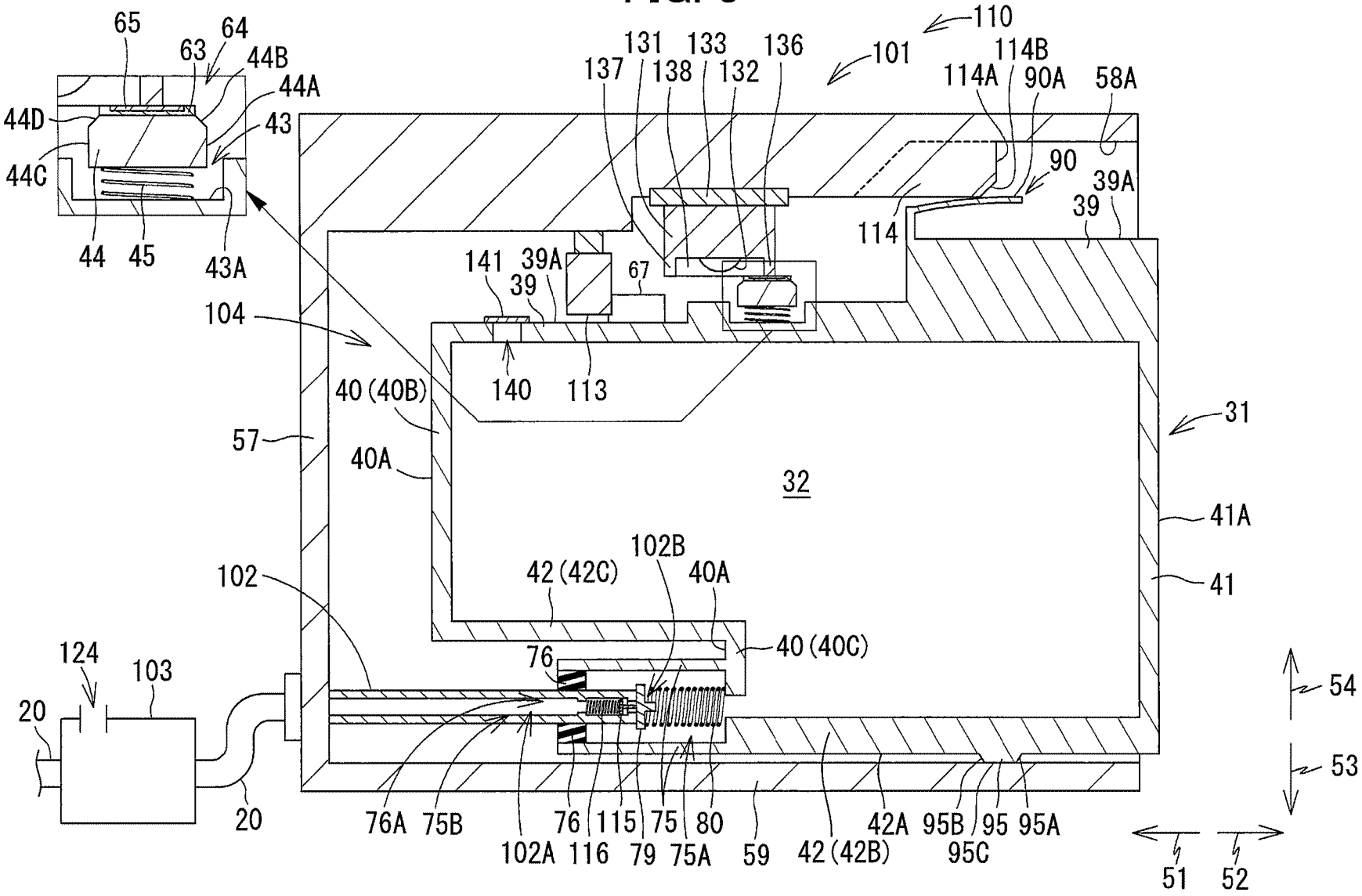
FIG. 8 is a vertical cross-sectional view illustrating a state where the ink cartridge according to the embodiment is further inserted into the cartridge-attachment portion from the state of FIG. 7.

In the state illustrated in FIG. 8, the rearward urging forces of the coil springs 80 and 116 are applied to the ink cartridge 30. As the ink cartridge 30 is further inserted frontward into the cartridge holder 101 from the state in FIG. 8 against the urging forces of the coil springs 80 and 116, the circuit board 64 reaches a position immediately below the contacts 132. At this time, the support member 44 and the circuit board 64 are positioned further frontward than the rear wall 136 to be spaced away from the rear wall 136. Therefore, the support member 44 and the circuit board 64 are moved upward due to the urging force of the coil spring 45 such that the circuit board 64 is moved from its second position to its first position. As a result, each of the electrodes 65 of the circuit board 64 is brought into contact with the corresponding one of the contacts 132 from downward as illustrated in FIG. 9, thereby establishing electrical connection between the electrodes 65 and the contacts 132.

As the electrodes 65 contact and are electrically connected to the corresponding contacts 132, a voltage is applied to one of the four electrodes 65; another of the four electrodes 65 is grounded; and an electric power is supplied to another of the four electrodes 65. Further, due to establishment of the electrical connection between the contacts 132 and the corresponding electrodes 65, the memory of the circuit board 64 is brought into electrical connection to the controller 1 (see FIG. 1). As a result, the controller 1 can access the memory of the circuit board 64 so that data stored in the memory is inputted into the controller 1. As described above, the state of the ink cartridge 30 illustrated in FIG. 9 is the attached state of the ink cartridge 30.

Hereinafter, the attached state of the ink cartridge 30 in the cartridge-attachment portion 110 (the ink cartridge 30 in its operational posture) will be described with reference to FIGS. 9 and 10.

In the attached state illustrated in FIG. 9, the tube 102 of the cartridge-attachment portion 110 is inserted inside the passage 75A of the cylinder 75. Hence, the ink in the storage chamber 32 can flow into the interior space 102A of the tube 102.

Further, the projection 67 is positioned between the light-emitting part and light-receiving part of the optical sensor 113 as illustrated in FIG. 9. Consequently, the projection 67 blocks the progression of light from the light-emitting part to the light-receiving part. That is, in the attached state of the ink cartridge 30, the projection 67 is positioned in the optical path of the light irradiated from the light-emitting part. Put different way, the optical sensor 113 is arranged such that the light-blocking surface of the projection 67 is located on the optical path of the light irradiated from the light-emitting part when the ink cartridge 30 is in the attached state. At this time, the optical sensor 113 outputs a low level detection signal to the controller 1 (see FIG. 1).

Also, in the attached state illustrated in FIG. 9, the front wall 137 of the connector 130 is positioned frontward of the circuit board 64, while the rear wall 136 of the connector 130 is positioned rearward of the circuit board 64. That is, the electrodes 65 are interposed between the front wall 137 and the rear wall 136 in the front-rear direction when the ink cartridge 30 is in the attached state. In other words, the rear wall 136 and the front wall 137 are juxtaposed in the front-rear direction with the electrodes 65 of the ink cartridge 30 in the attached state interposed therebetween.

Further, as illustrated in FIG. 3B, the right wall 138 of the connector 130 is positioned rightward of the circuit board 64, whereas the left wall 139 of the connector 130 is positioned leftward of the circuit board 64 in the attached state of the ink cartridge 30. Further, bottom edges of the right wall 138 and the left wall 139 are positioned lower than the electrodes 65. With this configuration, the right wall 138 and the left wall 139 interpose the electrodes 65 therebetween in the left-right direction when the ink cartridge 30 is in the attached state. That is, the right wall 138 and the left wall 139 are juxtaposed in the left-right direction with the electrodes 65 of the ink cartridge 30 in the attached state interposed therebetween.

In the attached state of the ink cartridge 30 in FIG. 9, the top surface 90A of the resilient member 90 is in contact with the rib 114 from below. At this time, the resilient member 90 is resiliently deformed as described above. That is, when the ink cartridge 30 is in the attached state, the resilient member 90 is compressed between the housing 31 and the rib 114 due to the resilient deformation thereof.

In the attached state of the ink cartridge 30 in FIG. 9, the bottom surface 95C of the protruding part 95 is in contact with the bottom wall 59 from the upper side thereof.

As described above, the top surface 90A of the resilient member 90 is in contact with the rib 114 from below while being resiliently deformed, and the bottom surface 95C of the protruding part 95 is in contact with the bottom wall 59 from above when the ink cartridge 30 is in the attached state. Through the contacts between the top surface 90A and the rib 114, and the bottom surface 95C and the bottom wall 59, resistance forces against a force that moves the ink cartridge 30 rearward is applied to each of a portion between the top surface 90A and the rib 114, and a portion between the bottom surface 95C and the bottom wall 59. These resistance forces cause the ink cartridge 30 to be retained in the cartridge holder 101. In other words, the ink cartridge 30 is inserted into the cartridge holder 101 with pressure.

Note that, in a state where the ink cartridge 30 is not inserted into the cartridge holder 101, the bottom surface 95C and an upper end of the resilient member 90 provides a distance in the up-down direction greater than a distance in the up-down direction between the bottom surface of the bottom wall 59 and a surface of the rib 114 that faces downward in the cartridge holder 101.

Further, in the attached state of the ink cartridge 30 illustrated in FIG. 9, the top surface 90A and the rib 114 are in abutment against each other at an abutment position P2, and the bottom surface 95C and the bottom wall 59 are in abutment against each other at an abutment position P3. The abutment position P2 has a portion positioned at the same position as a portion of the abutment position P3 in the front-rear direction. Further, the abutment position P2 and the abutment position P3 are positioned at the position the same as each other in the left-right direction. That is, in the plan view of the ink cartridge 30 in the attached state, the abutment position P2 is overlapped with the abutment position P3.

Note that, while it is preferable that the abutment position P2 and the abutment position P3 are overlapped with each other in the plan view of the ink cartridge 30 in the attached state, the abutment position P2 and the abutment position P3 may not be overlapped with each other.

As illustrated in FIG. 9, the abutment position P2 and the abutment position P3 are positioned further rearward than the intermediate position P1 when the ink cartridge 30 is in the attached state.

Note that it is preferable that both the abutment position P2 and the abutment position P3 are further rearward than the intermediate position P1 in the attached state of the ink cartridge 30. However, at least one of the abutment position P2 and the abutment position P3 may be positioned further frontward than the intermediate position P1.

In the attached state of the ink cartridge 30, the following inequality (1) is satisfied:

$$W1<(L2/L1)\cdot W2 \quad (1)$$

Here, a distance W11 in the left-right direction between a right end of the rib 114 and a right end of the top surface 90A illustrated in FIG. 10 is W1 in the inequality (1). Alternatively, a distance W12 in the left-right direction between a left end of the rib 114 and a left end of the top surface 90A illustrated in FIG. 10 may be W1 in the inequality (1). The distance W11 and the distance W12 are the same as each other in the present embodiment, but in a case where the distance W11 and the distance W12 are different from each other, it is preferable that one of the distance W11 and the distance W12, whichever is smaller, is employed as W1.

Further, as illustrated in FIG. 6A, a dimension in the left-right direction of each electrode 65 is W2 in the inequality (1). The four electrodes 65 have dimensions in the left-right direction the same as one another in the present embodiment. However, if the electrodes 65 have dimensions in the left-right direction different from one another, it is preferable that a dimension in the left-right direction of one electrode 65 which is smallest among the four electrodes 65 is employed as W2.

Further, L1 in the inequality (1) is a shortest distance in the front-rear direction between an abutment position P4 and an abutment position P5 illustrated in FIG. 9. That is, L1 is a distance in the front-rear direction between the abutment position P5 and a rear end of the abutment position P4. Here, the tube 102 is in abutment against the inner surface of the sealing member 76 defining the passage 75A at the abutment position P4, and the electrodes 65 are in abutment with the corresponding contacts 132 at the abutment position P5 in the attached state of the ink cartridge 30.

Still further, L2 in the inequality (1) is a shortest distance in the front-rear direction between the abutment position P4 and the abutment position P2. More specifically, L2 is a distance in the front-rear direction between the rear end of the abutment position P4 and a front end of the abutment position P2.

It is preferable that the above inequality (1) is satisfied when the ink cartridge 30 is in the attached state, but the inequality (1) may not be satisfied.

In order to detach the ink cartridge 30 from the cartridge holder 101 of the cartridge-attachment portion 110, the user grasps the ink cartridge 30 and pulls the ink cartridge 30 rearward. At this time, by pulling the ink cartridge 30 rearward with a force greater than the resistance forces described above, the ink cartridge 30 is moved rearward. Accordingly, the ink cartridge 30 can be extracted from the cartridge-attachment portion 110.

<Detecting Attachment of the Ink Cartridge 30 to the Cartridge-Attachment Portion 110>

Next, operations for detecting attachment of an ink cartridge 30 to the cartridge-attachment portion 110 will be described with reference to flowcharts illustrated in FIGS. 11 and 12.

Figure 11:
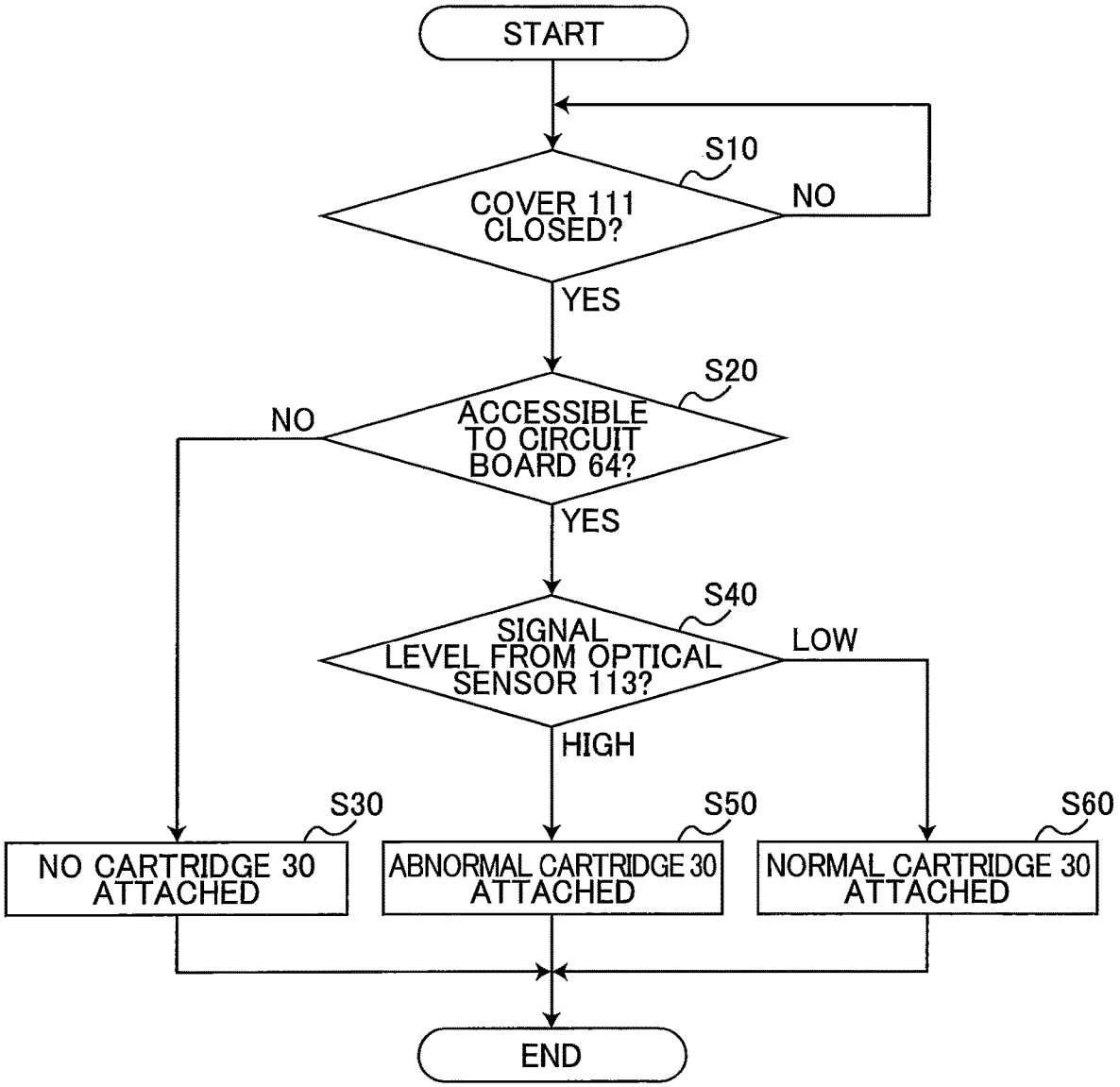
FIG. 11 is a flowchart illustrating steps way of determining whether the ink cartridge according to the embodiment is attached to the cartridge-attachment portion.
Figure 12:
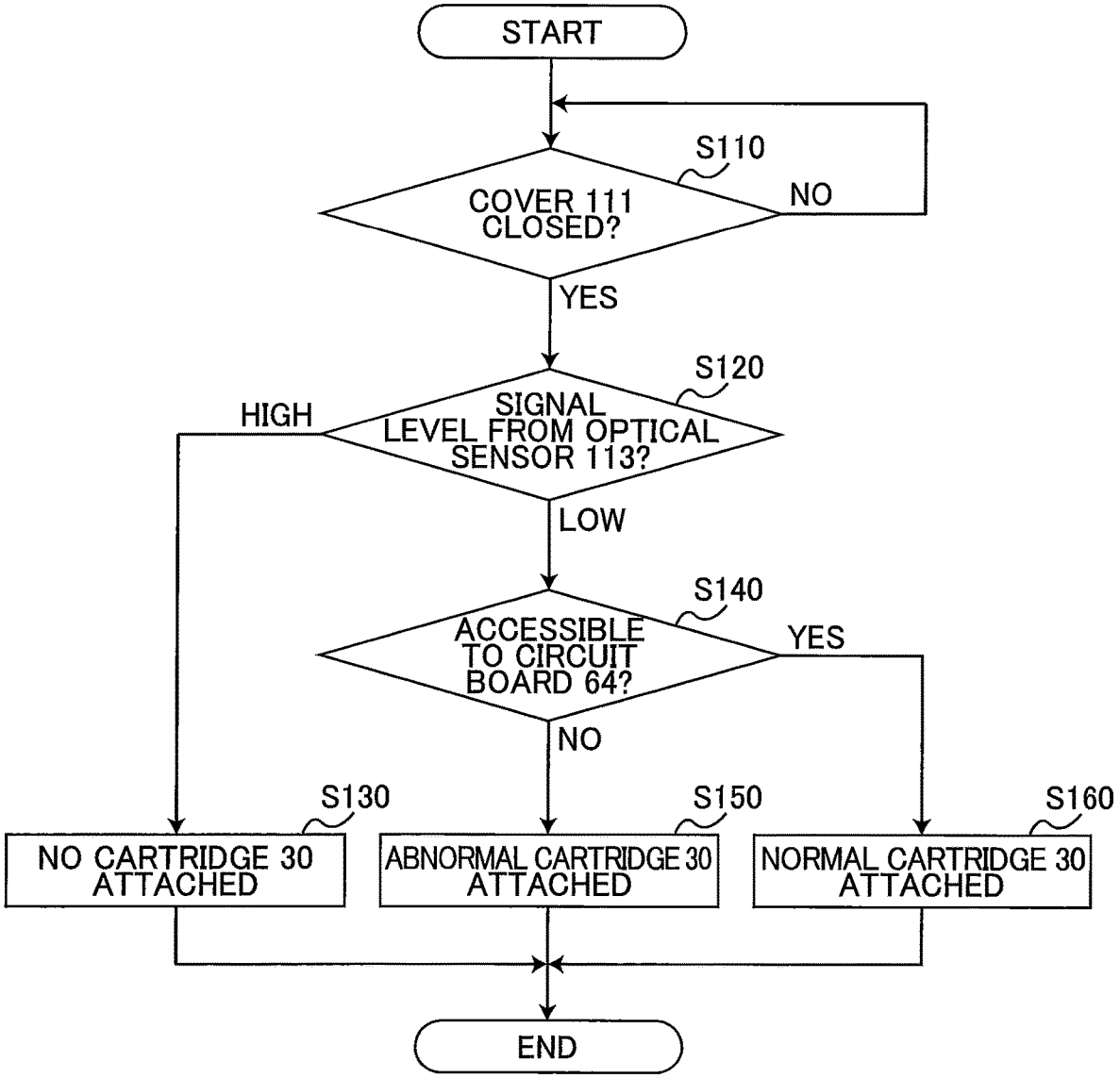
FIG. 12 is a flowchart illustrating steps another way of determining whether the ink cartridge according to the embodiment is attached to the cartridge-attachment portion.

The flowcharts of FIGS. 11 and 12 are configured to be initiated when the cover 111 is opened by the user. That is, the controller 1 is configured to launch the flowchart of FIG. 11 or the flowchart of FIG. 12 in response to receiving a high level signal outputted from the cover sensor 118.

As illustrated in FIG. 11, in S10 the controller 1 (see FIG. 1) determines whether the cover 111 is in the closed position. Specifically, the controller 1 determines that the cover 111 is in the closed position when the signal outputted from the cover sensor 118 changes to a low level signal. In a case where the cover 111 is not in the closed position (S10: NO), the controller 1 repeats the determination in S10 until the cover 111 is determined to be closed, i.e., until the signal outputted from the cover sensor 118 changes from high level to low level.

When the cover 111 is determined to be in the closed position (S10: YES), in S20 the controller 1 determines whether the memory on the circuit board 64 of the ink cartridge 30 is accessible, i.e., whether the controller 1 can read from or write to the memory. The controller 1 is able to access the memory on the circuit board 64 when the contacts 132 are in contact with and electrically connected to the electrodes 65 on the circuit board 64. When the contacts 132 are not in contact with the electrodes 65 on the circuit board 64, the controller 1 cannot access the memory.

If the controller 1 cannot access the memory of the circuit board 64 (S20: NO), in S30 the controller 1 determines that no ink cartridge 30 is mounted in the cartridge-attachment portion 110. In this case, the controller 1 notifies the user that no ink cartridge 30 is mounted by displaying a message on a display panel (not illustrated) provided on a housing of the printer 10 and/or emitting a beep or other sound from a speaker (not illustrated).

When the controller 1 can access the circuit board 64 (S20: YES), in S40 the controller 1 determines whether the signal outputted from the optical sensor 113 is high level or low level. When the projection 67 is positioned between the light-emitting part and light-receiving part of the optical sensor 113, the optical sensor 113 outputs a low level signal to the controller 1. When the projection 67 is not positioned between the light-emitting part and light-receiving part of the optical sensor 113, the optical sensor 113 outputs a high level signal to the controller 1.

When the signal outputted from the optical sensor 113 to the controller 1 is high level (S40: HIGH), the controller 1 determines in S50 that an abnormal ink cartridge 30 is attached to the cartridge-attachment portion 110. In this case, the controller 1 notifies the user that an abnormal ink cartridge 30 is mounted by displaying a message on the display panel (not illustrated) provided on the housing of the printer 10 and/or playing a beep or other sound from the speaker (not illustrated).

On the other hand, if the signal outputted by the optical sensor 113 is low level (S40: LOW), in S60 the controller 1 determines that a normal ink cartridge 30 is attached to the cartridge-attachment portion 110.

In the flowchart of FIG. 11, the controller 1 determines whether an ink cartridge 30 is mounted in the cartridge-attachment portion 110 based on whether the circuit board 64 is accessible, and determines whether the ink cartridge 30 mounted in the cartridge-attachment portion 110 is normal based on the level of the signal outputted from the optical sensor 113.

Alternatively, the controller 1 may be configured to determine whether an ink cartridge 30 is mounted in the cartridge-attachment portion 110 based on the level of the signal outputted from the optical sensor 113 and to determine whether the ink cartridge 30 mounted in the cartridge-attachment portion 110 is normal based on whether the circuit board 64 is accessible. Steps in this variation will be described next with reference to the flowchart in FIG. 12.

Referring to FIG. 12, the controller 1 first determines in S110 whether the cover 111 is in the closed position, as in S10 of the flowchart of FIG. 11. In a case where the cover 111 is determined to be not in the closed position (S110: NO), the controller 1 repeats the determination in S110 until the cover 111 is determined to be in the closed position, i.e., until the signal outputted from the cover sensor 118 changes from high level to low level.

When the controller 1 determines in S110 that the cover 111 is in the closed position (S110: YES), in S120 the controller 1 determines whether the signal outputted from the optical sensor 113 to the controller 1 is high level or low level.

If the signal outputted by the optical sensor 113 is high level (S120: HIGH), in S130 the controller 1 determines that no ink cartridge 30 is mounted in the cartridge-attachment portion 110. In this case, as in S30 of FIG. 11, the controller 1 notifies the user that no ink cartridge 30 is mounted.

However, if the signal outputted by the optical sensor 113 is low level (S120: LOW), in S140 the controller 1 determines whether the circuit board 64 of the ink cartridge 30 is accessible.

If the controller 1 cannot access the circuit board 64 (S140: NO), in S150 the controller 1 determines that an abnormal ink cartridge 30 is mounted in the cartridge-attachment portion 110. In this case, as in S50 of FIG. 11, the controller 1 notifies the user that an abnormal ink cartridge 30 is mounted.

On the other hand, if the controller 1 can access the circuit board 64 (S140: YES), in S160 the controller 1 determines that a normal ink cartridge 30 is mounted in the cartridge-attachment portion 110.

Operational and Technical Advantages of the Embodiment

In the attached state of the ink cartridge 30 according to the present embodiment, the top surface 90A of the resilient member 90 is in contact with the rib 114 provided at the top wall 58 while the resilient member 90 is resiliently deformed. Accordingly, the resilient member 90 is in pressure contact with the rib 114 provided at the top wall 58 due to its restoring force. In the meantime, a reaction force against the restoring force applied by the resilient member 90 is applied to the bottom surface 95C of the protruding part 95 in contact with the bottom wall 59. Thus, the bottom surface 95C is brought into pressure contact with the bottom wall 59. With this configuration, the ink cartridge 30 can be maintained in the attached state without providing a component for maintaining attachment of the ink cartridge 30 such as a lever. Further, the user can extract the ink cartridge 30 from the cartridge-attachment portion 110 only by pulling the ink cartridge 30 rearward without the necessity of moving the ink cartridge 30 in the up-down direction.

According to the present embodiment, the rib 114 is elongated in the front-rear direction. This configuration can raise a possibility that the state in which the rib 114 is in contact with the top surface 90A is maintained.

Assuming that the rib 114 and the top surface 90A are in abutment against each other at a certain point (point contact) when in the side view (i.e., when the ink cartridge 30 in the attached state is viewed from the right side or the left side), creep deformation is likely to occur on at least one of the rib 114 and the top surface 90A due to a force applied by the components in contact with the rib 114 and the top surface 90A. However, in the present embodiment, both of the rib 114 and the top surface 90A are elongated in the front-rear direction so that the rib 114 and the top surface 90A are in abutment against each other at a certain area (line contact) in the side view. Therefore, occurrence of the creep deformation described above can be suppressed.

According to the present embodiment, the inequality (1) indicated above is satisfied when the ink cartridge 30 is in its attached state. Hence, as long as the top surface 90A and the rib 114 are in abutment against each other, deviation in position of each electrode 65 in the left-right direction can be suppressed within the dimension in the left-right direction of each electrode 65 irrespective of degree of deviation in position of the top surface 90A relative to the rib 114 in the left-right direction. With this configuration, as long as the abutment of the top surface 90A against the rib 114 is maintained, disestablishment of the electrical connection between the electrodes 65 and the contacts 132 can be prevented even if the positional deviation of the electrodes 65 in the left-right direction occurs.

Further, assuming that the abutment position P2 (the position at which the top surface 90A abuts against the rib 114) and the abutment position P3 (the position at which the bottom surface 95C abuts against the bottom wall 59) are not overlapped with each other in the plan view, the following problems may occur: the ink cartridge 30 may lean relative to the left-right direction or the front-rear direction due to a force applied by the rib 114 provided at the top wall 58 to the ink cartridge 30, or a force applied by the bottom wall 59 to the ink cartridge 30.

However, according to the present embodiment, the abutment position P2 and the abutment position P3 are overlapped with each other in the plan view of the ink cartridge 30. This configuration can restrain the ink cartridge 30 from leaning relative to the left-right direction and the front-rear direction, thereby stabilizing the posture of the ink cartridge 30.

Further, under the assumption that the abutment position P2 and the abutment position P3 are positioned further frontward than the intermediate position P1, when one of the top surface 90A and the bottom surface 95C of the ink cartridge 30 is caught in the cartridge-attachment portion 110 during detachment of the ink cartridge 30 from the cartridge-attachment portion 110, the ink cartridge 30 is hindered from coming out. However, since the abutment position P2 and the abutment position P3 are both positioned further rearward than the intermediate position P1 in the present embodiment, the ink cartridge 30 can be readily pulled out even when the top surface 90A or the bottom surface 95C is caught in the cartridge-attachment portion 110.

Further, in the present embodiment, the circuit board 64 is positioned further frontward than the rear wall 136 and the bottom end of the rear wall 136 is positioned below the contacts 132 when the ink cartridge 30 is in the attached state. Therefore, the rear wall 136 can prevent the user from touching the contacts 132 and the electrodes 65 in the attached state of the ink cartridge 30.

Further, according to the present embodiment, even when the circuit board 64 and the rear wall 136 interfere with each other during horizontal insertion of the ink cartridge 30 into the cartridge-attachment portion 110, the circuit board 64 can be moved toward its second position against the urging force of the coil spring 45 by the rear wall 136 pushing the circuit board 64 downward, thereby restraining the rear wall 136 from hindering insertion of the ink cartridge 30 into the cartridge-attachment portion 110.

Variations and Modifications

While the description has been made in detail with reference to the embodiment(s) thereof, it would be apparent to those skilled in the art that many modifications and variations may be made therein without departing from the scope of the disclosure.

Figure 13:
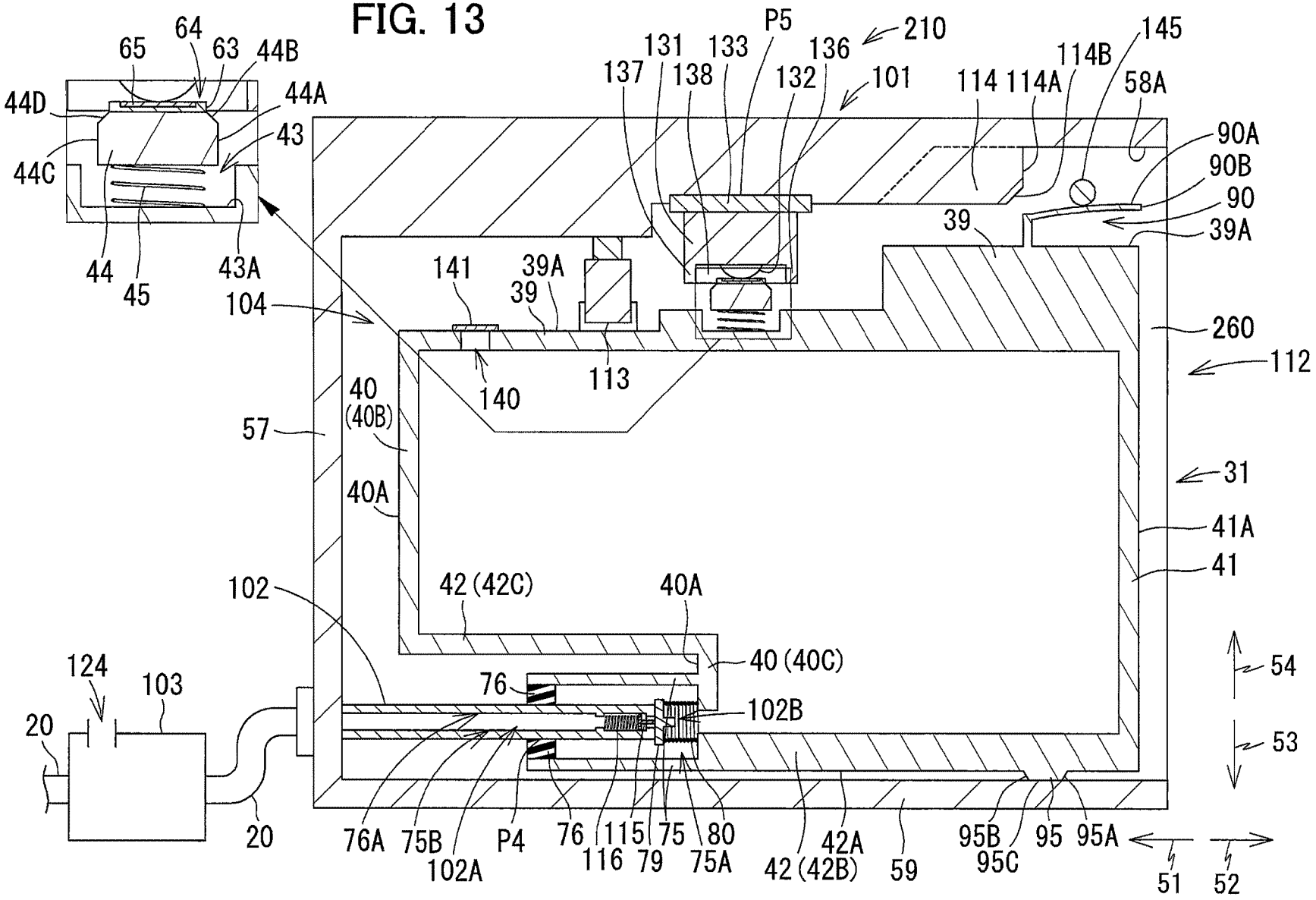
FIG. 13 is a vertical cross-sectional view of the ink cartridge according to the embodiment and a cartridge-attachment portion of a printer according to a modification.

As illustrated in FIG. 13, a cartridge-attachment portion 210 according to a modification includes a shaft 145. The shaft 145 extends in the left-right direction at a position in the vicinity of the top wall 58 and the opening 112 of the cartridge holder 101. The shaft 145 is a bar-like member extending in the left-right direction over the interior space 104 of the cartridge holder 101. The shaft 145 is, for example, solid cylinder formed of metal. The shaft 145 has one end in the left-right direction fixed to one of a pair of side walls 260, and another end in the left-right direction fixed to another of the pair of side wall 260.

In the cartridge-attachment portion 210 including the shaft 145, the resilient member 90 of the ink cartridge 30 may contact the shaft 145 instead of contacting the rib 114. That is, the resilient member 90 of the ink cartridge 30 in the attached state may be resiliently deformed to be compressed at a position between the housing 31 and the shaft 145, as illustrated in FIG. 13. Note that it is preferable that a rear end 90B of the resilient member 90 is positioned further rearward than the shaft 145 when the ink cartridge 30 is in the attached state.

According to the modification illustrated in FIG. 13, since the rear end 90B of the resilient member 90 of the ink cartridge 30 in the attached state is positioned further rearward than the shaft 145, the resilient member 90 is unlikely to be damaged by being hooked to the shaft 145 when the ink cartridge 30 is extracted from the cartridge-attachment portion 110.

In the embodiment described above, the resilient member 90 is provided on the top surface 39A of the top wall 39 while the protruding part 95 is provided at the bottom surface 42A of the bottom wall 42. However, the configuration other than that described above may be employed. An ink cartridge 330 according to a variation illustrated in FIG. 14 includes a housing 331 provided with a bottom wall 342 and a top wall 339, a resilient member 390 having a bottom surface 390C, and a protruding part 395 having a rear surface 395A, a front surface 395B, and a top surface 395D. The ink cartridge 330 differs from the ink cartridge 30 according to the above embodiment in that the resilient member 390 is provided at a bottom surface 342A of the bottom wall 342 and the protruding part 395 provided at a top surface 339A of the top wall 339. When the ink cartridge 330 is in its attached state illustrated in FIG. 14, the bottom surface 390C of the resilient member 390 is in abutment against the bottom wall 59 from above so that the resilient member 390 is resiliently deformed to be compressed upward. At this time, the top surface 395D of the protruding part 395 is in abutment against the rib 114 from below.

Note that, in a case where the cartridge-attachment portion 110 includes the shaft 145 as in the modification described above, the top surface 395D of the protruding part 395 may abut against the shaft 145 from below.

The resilient member 90 may be provided at both the top surface 39A of the top wall 39 and the bottom surface 42A of the bottom wall 42.

In the embodiment, the modifications and the variations described above, the resilient member 90 or the protruding part 395 abuts against the rib 114 or the shaft 145 from below. However, the resilient member 90 and the protruding part 395 may abut against a portion of the top wall 58 other than the rib 114 and the shaft 145. For example, the resilient member 90 and the protruding part 395 may abut against a bottom surface 58A (see FIG. 2) of the top wall 58 from below.

While the resilient member 90 is a leaf spring in the present embodiment, a member other than the leaf spring may be employed as the resilient member 90. For example, the resilient member 90 may be a coil spring.

The circuit board 64 is supported to the top surface 39A through the coil spring 45 in the above embodiment. However, the circuit board 64 may be supported to the top surface 39A through another resilient member other than the coil spring. For example, the circuit board 64 may be supported to the top surface 39A through a leaf spring or a rubber.

In the embodiment described above, by abutting against the bottom wall 59 from above, the protruding part 95 retains the ink cartridge 30 in the cartridge holder 101 (i.e., in the attached state) in cooperation with the resilient member 90. However, components in the ink cartridge 30 other than the protruding part 95 may function as the protruding part 95 to retain the ink cartridge 30 in the cartridge holder 101 in cooperation with the resilient member 90. For example, in a case where the protruding part 95 is dispensed with, the bottom wall 42 of the housing 31 is in abutment against the bottom wall 59 from above in the attached state of the ink cartridge 30. Accordingly, the bottom surface 42A of the bottom wall 42 retains the ink cartridge 30 in the cartridge holder 101 in cooperation with the resilient member 90. In this case, the bottom wall 42 functions as an example of the second abutment surface.

In the embodiment described above, the passage 75A (opening 75B) of the cylinder 75 is configured to be closed and opened by the valve 79. However, instead of the valve 79, a seal may be used to close the opening 75B, for example.

More specifically, a seal may be affixed to a front surface of the cylinder 75 so as to close the through-hole 76A in the ink cartridge 30 prior to insertion into the cartridge-attachment portion 110. Since the through-hole 76A is sealed by the seal, ink in the storage chamber 32 does not flow out from the ink cartridge 30 through the through-hole 76A. The seal may be punctured and broken by the tube 102 of the cartridge-attachment portion 110 during the insertion of the ink cartridge 30 into the cartridge-attachment portion 110, thereby opening the through-hole 76A to provide communication between the storage chamber 32 (passage 75A) and the interior space 102A of the tube 102.

Figure 14:
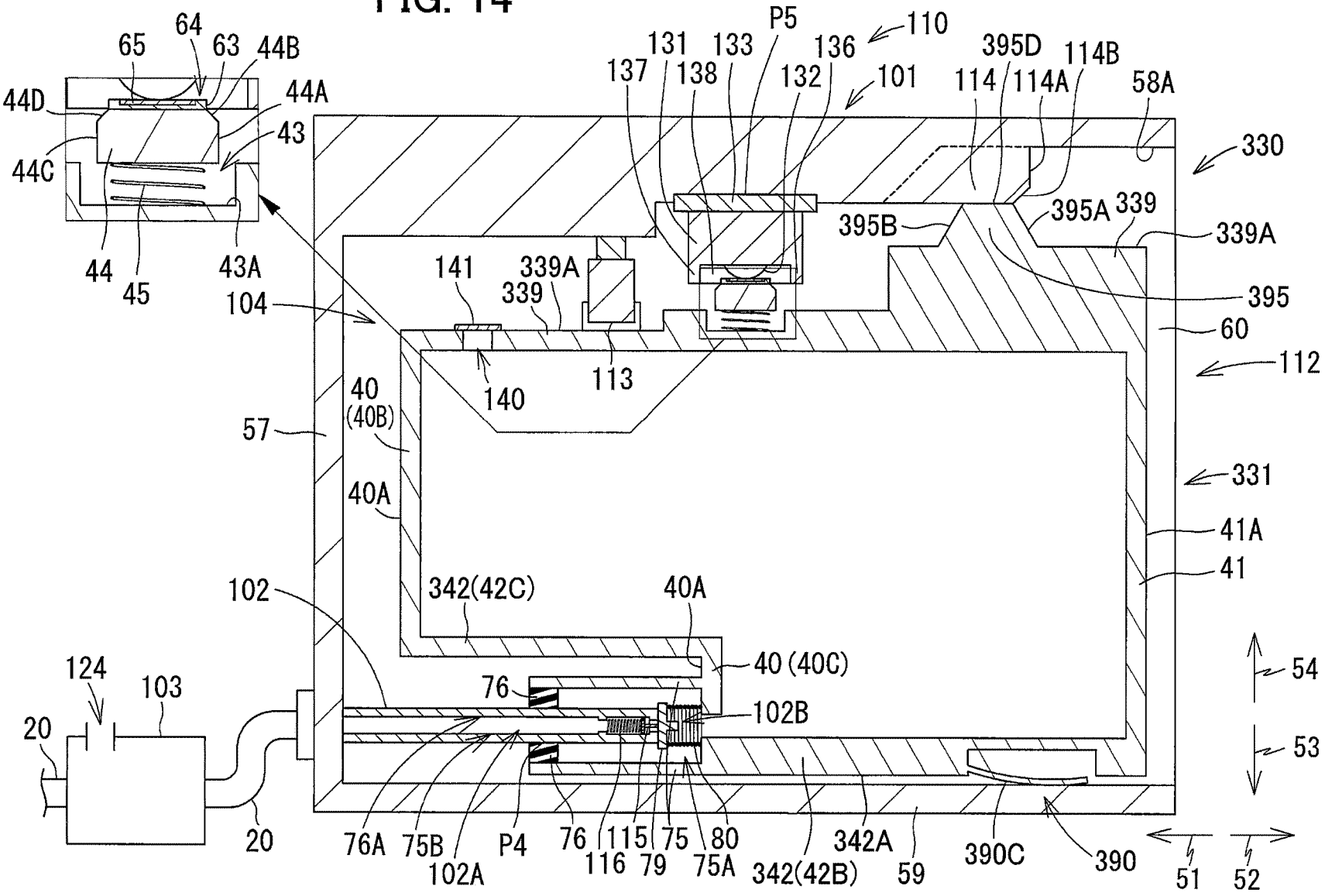
FIG. 14 is a vertical cross-sectional view of an ink cartridge according to a variation is attached to the cartridge-attachment portion of the printer according to the embodiment.
Figure 15:
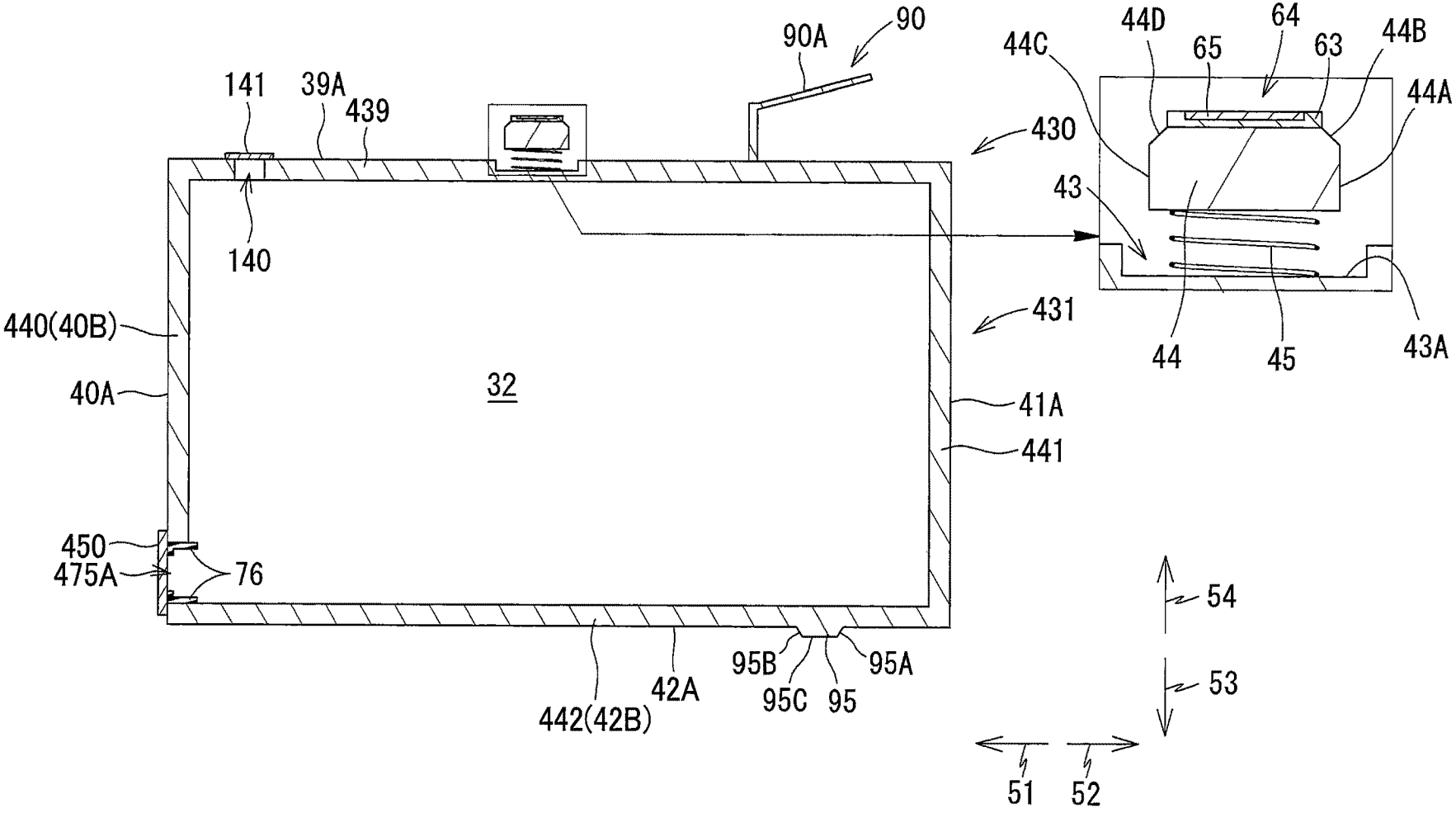
FIG. 15 is a vertical cross-sectional view of an ink cartridge according to another variation.

Still further, the ink cartridge 30 may have a different outline from the depicted embodiment (FIGS. 4 to 6 and 13) and the variation (FIG. 14). FIG. 15 illustrates an ink cartridge 430 according to another variation of the embodiment. The ink cartridge 430 of this variation has a generally rectangular parallelepiped shape, and the projection 67, the cylinder 75, the valve 79 and the coil spring 80 are dispensed with. Specifically, the ink cartridge 430 includes a housing 431 configured of a front wall 440, a top wall 439, a rear wall 441, and a bottom wall 442. The housing 431 has a generally rectangular shape in a vertical cross-section. In this variation, the front wall 440 is formed with a passage 475A penetrating the same in the front-rear direction. The passage 475A is closed with a seal 450.

In the embodiment described above, ink is described as an example of liquid, but the liquid cartridge of the disclosure may store liquid other than ink, such as pretreatment liquid that is ejected onto sheets or the like prior to ink during a printing operation, or water for cleaning the recording head 21.

REMARKS

The ink cartridges 30, 330, and 430 are examples of a liquid cartridge. The housings 31, 331, and 431 are examples of a housing. The storage chamber 32 is an example of a storage chamber. Ink is an example of liquid. The circuit board 64 is an example of a circuit board. The coil spring 45 is an example of a deformable member. The coil spring 45 is also an example of a resilient member. The upper surface 90A is an example of a movable surface. The support member 44 is an example of a supporting member. The passages 75A and 475A are examples of a liquid passage. The inclined surfaces 44B and 44D are examples of an inclined surface. The front walls 40 and 440 are examples of a front wall. The rear walls 41 and 441 are examples of a rear wall. The top walls 39, 339 and 439 are examples of an upper wall. The bottom walls 42, 342 and 442 are examples of a lower wall. The printer 10 is an example of a liquid ejecting device. The protruding parts 95 and 395 are examples of a protruding part. The top surface 395D is an example of a top surface. The bottom surface 95C is an example of a bottom surface. The recessed portion 43 is an example of a recessed portion. The projection 67 is an example of a plate. The resilient members 90 and 390 are examples of a leaf spring. The frontward direction 51 is an example of a first lateral direction. The rearward direction 52 is an example of a second lateral direction. The downward direction 53 and the upward direction 54 is an example of a vertical direction.

What is claimed is:

1. A liquid cartridge comprising:

a housing formed with a storage chamber configured for storing liquid therein;

a liquid passage extending in a first direction from the housing, the liquid passage being in communication with the storage chamber;

a plate positioned higher than the storage chamber in a vertical direction perpendicular to the first direction;

a circuit board positioned higher than the storage chamber in the vertical direction and positioned further in a second direction opposite the first direction than the plate, the circuit board being supported by the housing so as to be vertically movable relative to the housing; and a resilient member positioned further in the second direction than the plate, the resilient member being resiliently deformable relative to the housing.

2. The liquid cartridge according to claim 1, further comprising a movable surface positioned higher than the storage chamber in the vertical direction, the movable surface facing upward and being vertically movable relative to the housing.

3. The liquid cartridge according to claim 2, wherein the movable surface is positioned higher than the circuit board in the vertical direction.

4. The liquid cartridge according to claim 2, wherein the resilient member has an upper surface serving as the movable surface.

5. The liquid cartridge according to claim 1, further comprising a deformable member interposed between the storage chamber and the circuit board in the vertical direction, the deformable member being deformable relative to the housing to allow vertical movement of the circuit board.

6. The liquid cartridge according to claim 5, wherein the deformable member is one of a resiliently deformable member and an elastically deformable member.

7. The liquid cartridge according to claim 6, wherein the resiliently deformable member is a coil spring.

8. The liquid cartridge according to claim 5, wherein the housing includes an upper wall and a lower wall opposite to each other with respect to the storage chamber, the upper wall being formed with a recessed portion recessed downward to have a bottom end, and wherein the deformable member is supported on the bottom end of the recessed portion.

9. The liquid cartridge according to claim 5, further comprising a supporting member supporting the circuit board, the deformable member supporting the supporting member to move the supporting member vertically relative to the housing.

10. The liquid cartridge according to claim 9, wherein the liquid passage defines an axis extending in the first direction and the second direction, and wherein the supporting member has an inclined surface inclined relative to the axis.

11. The liquid cartridge according to claim 10, wherein the inclined surface is positioned further in the first direction than the circuit board and is inclined downward as extending further in the first direction.

12. The liquid cartridge according to claim 10, wherein the inclined surface is positioned further in the second direction than the circuit board and is inclined downward as extending further in the second direction.

13. The liquid cartridge according to claim 1, wherein the housing includes an upper wall and a lower wall opposite to each other with respect to the storage chamber, the liquid cartridge further comprising a protruding part provided at the lower wall to protrude downward at a position overlapping with the resilient member as viewed from above.

14. The liquid cartridge according to claim 1, wherein the plate has a top end that is positioned higher than the deformable member in the vertical direction.

15. The liquid cartridge according to claim 1, wherein the plate is formed of a material capable of blocking or attenuating light.

* * * * *